US012551811B2

(12) United States Patent
Erwin et al.

(10) Patent No.: US 12,551,811 B2
(45) Date of Patent: Feb. 17, 2026

(54) SYSTEM, PANEL AND METHOD

(71) Applicant: EVERPLAY LABS LIMITED, London (GB)

(72) Inventors: Anthony Mariner Erwin, London (GB); Craig Ronald Spencer, London (GB)

(73) Assignee: EVERPLAY LABS LIMITED, London (GB)

( * ) Notice: Subject to any disclaimer, the term of this patent is extended or adjusted under 35 U.S.C. 154(b) by 328 days.

(21) Appl. No.: 18/023,046

(22) PCT Filed: Aug. 25, 2021

(86) PCT No.: PCT/EP2021/073530
§ 371 (c)(1),
(2) Date: Feb. 24, 2023

(87) PCT Pub. No.: WO2022/043393
PCT Pub. Date: Mar. 3, 2022

(65) Prior Publication Data

US 2023/0311014 A1 Oct. 5, 2023

(30) Foreign Application Priority Data

Aug. 25, 2020 (GB) ..... 2013279
Jan. 29, 2021 (GB) ..... 2101227

(51) Int. Cl.
*A63H 33/00* (2006.01)
*A63H 33/04* (2006.01)
*E04C 2/38* (2006.01)

(52) U.S. Cl.
CPC ..... *A63H 33/008* (2013.01); *A63H 33/046* (2013.01); *E04C 2/38* (2013.01)

(58) Field of Classification Search
CPC ..... A63H 33/008; A63H 33/046; E04C 2/38; G09B 1/38; A63F 9/34; A63F 2007/3662
See application file for complete search history.

(56) References Cited

U.S. PATENT DOCUMENTS

D226,120 S 1/1973 Ogsbury et al.
3,872,620 A 3/1975 Daenen
(Continued)

FOREIGN PATENT DOCUMENTS

CA 170205 3/2017
CA 217395 9/2023
(Continued)

OTHER PUBLICATIONS

Erwin, Anthony Mariner, International Search Report and Written Opinion for PCT/EP2021/073530, filed Aug. 25, 2021, mailed Nov. 26, 2021, 10 pgs.
(Continued)

*Primary Examiner* — Gisele D Ford
(74) *Attorney, Agent, or Firm* — Polsinelli PC

(57) ABSTRACT

A system for building a play area can include two or more panels, each of the two or more panels including a connector and at least one magnet positioned in the connector such that the at least one magnet is able to rotate, the at least one magnet including first and second magnets housed in respective first and second ends of the connector, the at least one magnet including at least one cylindrical magnet, the at least one cylindrical magnet being diametrically magnetized; and first and second dowels connected by the connector; each of the two or more panels being configured such that when at least one edge of each of the first and second panels are brought towards each other from any direction, the at least one magnet in each panel orientates such that a magnetic connection is formed between the two or more panels.

24 Claims, 21 Drawing Sheets

(56) References Cited

U.S. PATENT DOCUMENTS

D255,196 S 6/1980 Durrant
4,258,479 A * 3/1981 Roane ..... A63H 33/046 434/211
4,334,871 A * 6/1982 Roane ..... A63H 33/046 434/211
D284,611 S 7/1986 Cotney et al.
D308,274 S 5/1990 Gosselin et al.
5,009,625 A * 4/1991 Longuet-Higgins ..... A63H 33/046 446/85
5,417,603 A * 5/1995 De Chazal ..... A63F 9/1204 108/62
5,651,715 A * 7/1997 Shedelbower ..... A63F 9/088 446/490
6,065,253 A * 5/2000 Ojeda ..... A63H 3/52 446/139
6,464,553 B2 10/2002 Huang
D487,272 S 3/2004 Korpai
D487,465 S 3/2004 Korpai
D488,160 S 4/2004 Korpai
D488,161 S 4/2004 Korpai
6,969,294 B2 * 11/2005 Vicentelli ..... A63F 9/34 446/92
7,066,778 B2 * 6/2006 Kretzschmar ..... A63H 33/046 446/124
7,154,363 B2 * 12/2006 Hunts ..... H01F 7/0242 446/92
D550,270 S 9/2007 Astill
7,273,404 B2 * 9/2007 Kowalski ..... A63H 33/046 446/85
7,364,487 B2 * 4/2008 Evans ..... A63H 33/04 446/124
D614,250 S 4/2010 Frederiksen
D631,104 S 1/2011 With
D632,346 S 2/2011 Hardstaff
7,988,518 B2 * 8/2011 Kim ..... A63H 33/26 446/92
8,070,550 B2 * 12/2011 Song ..... A63H 33/046 446/92
8,458,863 B2 6/2013 Hunts
8,491,312 B2 * 7/2013 Rudisill ..... H01R 11/30 439/39
8,753,162 B2 6/2014 Jensen
8,904,688 B1 * 12/2014 Rue ..... B44D 3/185 40/781
9,022,829 B2 5/2015 Rosen et al.
D748,203 S 1/2016 Karunaratne
9,314,707 B2 * 4/2016 Ornstein ..... A63H 33/046
9,643,100 B2 5/2017 Fein et al.
D789,312 S * 6/2017 Wang ..... D21/491
9,713,777 B2 7/2017 Peterson
9,734,733 B2 * 8/2017 Murtagh ..... G09B 25/04
9,774,136 B2 * 9/2017 Szeto ..... H01R 35/04
10,063,009 B2 * 8/2018 Szeto ..... H01R 13/6205
10,080,977 B2 9/2018 Rosen et al.
10,217,388 B1 * 2/2019 Alkas ..... A47B 57/30
10,245,523 B2 4/2019 Lin
10,258,896 B2 * 4/2019 Ornstein ..... A63H 33/06
D868,904 S 12/2019 Mølgaard et al.
10,518,190 B2 * 12/2019 Rosen ..... A63H 33/046
D884,802 S 5/2020 Kelley et al.
D900,246 S 10/2020 Kelley et al.
D901,124 S 11/2020 Caudillo et al.
10,857,475 B2 * 12/2020 Moskowitz ..... A63H 33/108
10,918,963 B2 2/2021 Ornstein et al.
11,045,740 B2 * 6/2021 Wang ..... A63H 33/26
11,193,518 B2 * 12/2021 Di Quadri ..... A47B 47/0075
D969,233 S 11/2022 Li
D985,682 S 5/2023 Erwin et al.
11,642,604 B1 5/2023 Xie
D1,003,611 S 11/2023 Cohen
D1,005,408 S 11/2023 Wang
12,145,078 B2 11/2024 Xie
D1,053,275 S 12/2024 Chen
12,179,981 B2 12/2024 Baca
2002/0098774 A1 7/2002 Huang
2002/0193046 A1 * 12/2002 Zebersky ..... A63H 3/52 446/108
2006/0166590 A1 * 7/2006 Ishikawa ..... A63H 33/086 446/120
2006/0240737 A1 * 10/2006 Yoon ..... A63H 33/046 446/92
2007/0287353 A1 * 12/2007 Vicentelli ..... A63H 33/108 446/92
2009/0093182 A1 4/2009 Jacobs et al.
2010/0192437 A1 8/2010 Fallander
2012/0164913 A1 * 6/2012 Pomeroy ..... A63H 33/046 446/137
2013/0267145 A1 * 10/2013 Rosen ..... A63H 33/046 446/92
2014/0094083 A1 * 4/2014 Vandoren ..... A63H 33/046 446/92
2014/0179194 A1 * 6/2014 Fein ..... A63H 33/046 446/92
2014/0227934 A1 * 8/2014 Rudisill ..... A63H 33/046 446/92
2014/0227935 A1 8/2014 Yoon
2014/0256210 A1 * 9/2014 Johnson ..... A63H 33/046 446/108
2014/0302741 A1 * 10/2014 Whittaker ..... A63H 33/046 446/92
2016/0074766 A1 3/2016 Choi
2016/0089614 A1 * 3/2016 Cochella ..... A63H 33/046 446/111
2016/0184727 A1 6/2016 Ornstein et al.
2016/0206968 A1 * 7/2016 Choi ..... A63H 33/086
2017/0149171 A1 * 5/2017 Szeto ..... H04M 1/0274
2017/0182429 A1 * 6/2017 Choi ..... A63H 33/046
2017/0232357 A1 8/2017 Rosen et al.
2018/0056206 A1 * 3/2018 Micko ..... A63H 33/046
2018/0185765 A1 * 7/2018 Zheng ..... A63H 33/008
2018/0258965 A1 * 9/2018 Danko ..... F16B 1/00
2020/0184852 A1 * 6/2020 Hartloff ..... G09B 27/08
2020/0246715 A1 8/2020 Bensussan et al.
2021/0204721 A1 * 7/2021 Srikanchana ..... A63G 31/00
2021/0213369 A1 * 7/2021 Yamaai ..... A63H 29/22
2021/0220723 A1 * 7/2021 Costello ..... A63F 3/00
2022/0047960 A1 * 2/2022 Hoenigschmid ..... A63H 33/046

FOREIGN PATENT DOCUMENTS

CN 108367204 A 8/2018
CN 111803973 10/2020
GB 6117065 2/2021
GB 6205735 5/2022
GB 6329772 11/2023
GB 6329776 12/2023
GB 6329778 12/2023
KR 3006235920002 11/2011
KR 3008624330000 6/2016
KR 3008628280000 6/2016
RU 180574 U 6/2018
WO 2010088695 8/2010
WO 2017155701 A1 9/2014
WO 2022043393 3/2022

OTHER PUBLICATIONS

Erwin, Anthony Mariner; Notice of Allowance for Design U.S. Appl. No. 35/512,853, filed Aug. 4, 2021, mailed Feb. 1, 2023, 8 pgs.
Erwin, Anthony; Non-Final Office Action for Design U.S. Appl. No. 35/512,853, filed Aug. 4, 2021, mailed Oct. 12, 2022, 15 pgs.
Erwin, Anthony Mariner; Search Report for United Kingdom application No. GB2013279.1, mailed Feb. 4, 2021, 3 pgs.
Erwin, Anthony Mariner; Notification of the First Office Action for Chinese Patent Application No. 202180052427.4, filed Aug. 25, 2021, mailed Apr. 24, 2025, 19 pgs.

(56) References Cited

OTHER PUBLICATIONS

Instagram @getsuperspace "Big news! We have now completed our final Everplay design." posted Feb. 14, 2021 [online], [site visited Feb. 20, 2025]. Available from Internet: <URL: https://www.instagram.com/p/CLS7NEhlYZg/> (Year: 2021).
Instagram @getsuperspace "Rectangles have arrived!" posted Sep. 13, 2022 [online], [site visited Feb. 20, 2025]. Available from Internet :<URL: https://www.instagram.com/p/Cic4c8h M E4A/> (Year: 2022).
Instagram @getsuperspace "Who feels like they need a little space of their own from time to time?" posted Jun. 27, 2022 [online], [site visited Feb. 20, 2025]. Available from Internet: <URL: https://www.instagram.com/p/CfU8uZohxnz/> (Year: 2022).
Spencer, Craig Ronald; Non-Final Office Action for Design U.S. Appl. No. 29/858,527, filed Nov. 1, 2022, mailed Feb. 26, 2025, 28 pgs.
Spencer, Craig Ronald; Applicant-Initiated Interview Summary for Design U.S. Appl. No. 29/986,779, filed Jan. 18, 2025, mailed May 28, 2025, 3 pgs.
Spencer, Craig Ronald; Non-Final Office Action for Design U.S. Appl. No. 29/986,779, filed Jan. 18, 2025, mailed Mar. 4, 2025, 19 pgs.
(191603-6042) Spencer, Craig Ronald; Non-Final Office Action for Design U.S. Appl. No. 29/986,780, filed Jan. 18, 2025, mailed Mar. 4, 2025, 17 pgs.
Geomag "Geomag Magnetic Toys Classic Tiles 52-Piece Building Set," accessed on: Dec. 13, 2024, retrieved from: https://www.amazon.com/Magnetic-STEM-endorsed-Educational-Building-Recycled/dp/B083YN1KSN, 6 pages.
HearthSong "16 Panel Castle Fantasy Forts Kit," archive date: Mar. 22, 2023, retrieved from: http://web.archive.org/web/20230322105418/https://www.hearthsong.com/products/16-panel-castle-fantasy-forts-kit, 16 pages.
HearthSong "16 Panel Castle Fantasy Forts Kit," archive date: Oct. 7, 2022, retrieved from: http://web.archive.org/web/20221007181259/https://www.hearthsong.com/products/16-panel-castle-fantasy-forts-kit, 11 pages.
ImagineHaven "Magnetic Panel Playhouse Big Set—16 Panel Kit," accessed on Dec. 13, 2024, accessed at: https://us.amazon.com/Magnetic-Panel-Playhouse-Big-Built/dp/BOD8V1LGZW. 5 pages.
Lakeshore "Jumbo Magnetic Building Tiles," accessed on Dec. 13, 2024, accessed at: https://www.lakeshorelearning.com/products/blocks-manipulatives/building-sets/jumbo-magnetic-building-tiles/p/LA214/, 4 pages.
Magformers Magnetic Toys, "Magformers US," retrieved on Jan. 16, 2025, retrieved from: https://margormers.com, 7 pages.
Magformers, "Rainbow 26PC Set," accessed on Jan. 16, 2025, available before Nov. 1, 2022, accessed at: https://www.amazon.com/Magformers-Educational-Problem-Solving-Abilities-Recognition/dp/B00HVB06NM/ref=sr_1_5 _?crid=10AA74JFOSU3W&dib=, 9 pages.
Magna-Tiles Classic 32-Piece Magnetic Construction Set, accessed on: Jan. 16, 2025, available before Nov. 1, 2022, accessed at: wwww.amazon.co.uk/MAGNA-TILES-Construction-Engineering-Manipulatives-Essentials/dp/B000CBSNKQ/ref=sr_1_5?dib=eyJ1ljoiMSJ9.JX6BY, 9 pages.
Magna-Tiles, "Magna-Tiles Classic 32-Piece Magnetic Construction Set," accessed on Jan. 16, 2025, available before Nov. 1, 2022, accessed at: www.amazon.com/Magna-Tiles-32-Piece-Award-Winning-Creativity-Educational/dp/B000CBSNKQ/ref=asc_dr_B000CBSNKQ?hvadid=721245, 12 pages.
Magna-Tiles, "Our Story," accessed on Jan. 16, 20225, retrieved from: https://www.magnatiles.com/our-story/, 9 pages.

* cited by examiner

SYSTEM, PANEL AND METHOD

FIELD OF THE INVENTION

The present disclosure relates to a magnetic system. More particularly, the present disclosure relates to a magnetic system of one or more modules which can be used to create a play area. In some examples, play area comprises a life-sized child's play area.

BACKGROUND

Known systems for building play areas include, for example, building blocks. Such building blocks can be dangerous when used by children, as the building blocks may not be securely attached to one another before a child starts to play in a play area. The play area may, in some cases, then collapse on the child and cause injury.

In systems for building a play area where blocks do have a securing mechanism, the securing mechanism may be difficult for children to understand and may be miscomprehended. As such, it may be difficult for children to safely use the securing mechanism for building a play area. Further, even if the child does manage to build a play area, the blocks may not be properly secured such that the blocks may still collapse on the child and cause injury.

SUMMARY OF INVENTION

In a first aspect, there is provided a system for building a play area comprising: two or more panels, each of the two or more panels comprising: a connector; and at least one magnet positioned in the connector such that the at least one magnet can rotate; wherein each of the two or more panels are configured such that when at least one edge of the first panel is brought towards at least one edge of the second panel from any direction, the at least one magnet in each panel orientate such that a magnetic connection is formed between the two or more panels; and wherein the at least one magnet comprises at least one cylindrical magnet, the at least one cylindrical magnet being diametrically magnetized. The the at least one magnet may comprise: a first magnet housed in a first end of the connector; and a second magnet housed in a second end of the connector, wherein the connector connects a first dowel and a second dowel.

According to some examples, the each of the panels are formed by connecting a plurality of connectors including the connector and a plurality of dowels including the first dowel and the second dowel; wherein each dowel of the plurality of dowels connects two of the plurality of connectors together.

According to some examples, the first magnet is held in place by a first clip that attaches to the first end of the first connector and the second magnet is held in place by a second clip that attaches to the second end of the first connector.

According to some examples, the first magnet is held in place in the first end of the first connector by the first dowel and the second magnet is held in place in the second end of the first connector by the second dowel.

According to some examples, the at least one housing portion is formed in between the first end of the first connector and the first clip.

According to some examples, the at least one housing portion is formed in between the first end of the first connector and the first dowel.

According to some examples, the at least one housing portion is formed in between the second end of the first connector and the second clip.

According to some example, the at least one housing portion is formed in between the second end of the first connector and the second dowel.

According to some examples, each housing portion of the at least one housing portion comprises a recess.

According to some examples, the system is for building a life sized children's play area.

According to some examples, the first clip comprises a first cavity for housing the first dowel and the second clip comprises a second cavity for housing the second dowel.

According to some examples, each of the two or more panels comprises at least one additional connector, wherein each connector houses two diametric cylindrical magnets, and wherein each connector connects two dowels, wherein the first dowel, the second dowel and the at least one additional dowel form the edges of each panel.

According to some examples, at least one housing portion of the connector is shaped to house an outer profile of the at least one magnet.

According to some examples, the system comprises at least one board configured to be connected to at least one panel of the two or more panels, wherein the at least one board can be used to display at least one image.

According to some examples, a face of the at least one panel comprises at least one magnet and the at least one board can be connected to the at least one magnet to position the at least one board on the at least one panel.

According to some examples, the at least one board comprises a magnet and/or a metallic section to connect to the at least one magnet of the face of the at least one panel.

According to some examples, at least one panel of the two or more panels comprises at least one of: a triangular panel; a square panel; a rectangular panel; a trapezoid panel.

According to some examples, at least one panel of the two or more panels comprises an aperture which provides a window for the play area.

According to some examples, at least one panel of the two or more panels comprises a plurality of panels and the system can be arranged to build the play area, and wherein the play area comprises at least one of: a play house; a stage; a scene; an exhibition display; a play car; a play spaceship; a box; furniture; floor tiles; a floor mat of combined panels; a toy roadway and a stage.

According to some examples, the system is configured to be secured to at least one external object in an environment surrounding the system.

According to some examples, at least one panel of the two or more panels is configured to be secured to the at least one external object.

According to some examples, when the panels are stacked on top of each other, the at least one magnet of each panel secures the panels to each other.

According to some examples, the at least one magnet is configured to provide a clicking noise when magnetically attaching to another magnet to indicate the magnetic attachment was successful.

According to some examples, the system comprises a foldable panel with pre-created foldable lines which can be folded to provide different shapes of the foldable panel, and wherein the foldable panel can be magnetically attached to the at least one magnet.

According to some examples, the foldable panel is configured to be secured to at least one external object.

According to some examples, the system comprises a panel that comprises at least one spherical magnet.

According to some examples, the foldable panel can be magnetically attached to at least one panel of the two or more panels to form a roof and/or a door for the play area.

According to some examples, a frame of each of the two or more panels is formed by connecting a plurality of connectors including the connector and a plurality of dowels including the first dowel and the second dowel; wherein each dowel of the plurality of dowels connects two of the plurality of connectors together.

In a second aspect, there is provided a panel for building a play area comprising: a connector; and at least one magnet positioned in the connector such that the at least one magnet can rotate; and wherein the at least one magnet comprises at least one cylindrical magnet, the at least one cylindrical magnet being diametrically magnetized. The at least one magnet may comprise a first magnet housed in a first end of the connector; a second magnet housed in a second end of the connector; wherein the first connector connects a first dowel of the panel and a second dowel of the panel.

According to some examples, the panel is formed by connecting a plurality of connectors including the connector and a plurality of dowels including the first dowel and the second dowel; wherein each dowel of the plurality of dowels connects two of the plurality of connectors together.

According to some examples, the panel is configured to magnetically attach to a blanket attachment using the at least one magnet.

According to some examples, at least one magnet comprises: a first magnet housed in a first end of a first connector of the panel; a second magnet housed in a second end of the first connector of the panel; wherein the first connector connects a first dowel of the panel and a second dowel of the panel.

According to some examples, the panel is configured such that the at least one magnet in the panel can orientate to align with a magnetic field of a magnet in a second panel when the panel is pushed towards the second panel.

According to some examples, the first magnet is held in place by a first clip that attaches to the first end of the first connector and the second magnet is held in place by a second clip that attaches to the second end of the first connector.

According to some examples, the at least one housing portion is formed in between the first end of the first connector and the first clip.

According to some examples, the at least one housing portion is formed in between the second end of the first connector and the second clip.

According to some examples, each housing portion of the at least one housing portion comprises a recess.

According to some examples, the panel is for building a life sized children's play area.

According to some examples, the first clip comprises a first cavity for housing the first dowel and the second clip comprises a second cavity for housing the second dowel.

According to some examples, the panel comprises at least one additional connector, wherein each connector houses two diametric cylindrical magnets and wherein each connector connects two dowels, wherein the first dowel, the second dowel and the at least one additional dowel form the edges of the panel.

According to some examples, the panel comprises a frame, the frame comprising: a plurality of connectors including the connector; a plurality of dowels including the first dowel and the second dowel; wherein each dowel of the plurality of dowels connects two of the plurality of connectors together to form the frame.

According to some examples, at least one housing portion of the connector is shaped to house an outer profile of the at least one magnet.

According to some examples, at least one board is configured to be connected to the panel, wherein the at least one board can be used to display at least one image.

According to some examples, a face of the panel comprises at least one magnet and the at least one board can be connected to the at least one magnet to position the at least one board on the panel.

According to some examples, the at least one board comprises a magnet and/or a metallic section to connect to the at least one magnet of the face of the panel.

According to some examples, the panel comprises at least one of: a triangular panel; a square panel; a rectangular panel; a trapezoid panel.

According to some examples, the panel comprises an aperture which provides a window for the play area.

According to some examples, the panel can be combined with a plurality of other panels to form a system, and the system can be arranged to build the play area, and wherein the play area comprises at least one of: a play house; a stage; a scene; an exhibition display; a play car; a play spaceship; a box; furniture; floor tiles; a floor mat of combined panels; a toy roadway and a stage.

According to some examples, the panel is configured to be secured to at least one external object in an environment surrounding the system.

According to some examples, the panel is configured to be secured to the at least one external object.

According to some examples, when the panels of the system are stacked on top of each other, the at least one magnet of each panel secures the panels to each other.

According to some examples, the at least one magnet is configured to provide a clicking noise when magnetically attaching to another magnet to indicate the magnetic attachment was successful.

According to some examples, the system comprises a foldable panel with pre-created foldable lines which can be folded to provide different shapes of the foldable panel, and wherein the foldable panel can be magnetically attached to the at least one magnet.

According to some examples, the foldable panel is configured to be secured to at least one external object.

According to some examples, the panel comprises at least one spherical magnet.

According to some examples, the foldable panel can be magnetically attached to the panel to form a roof and/or a door for the play area.

According to a third aspect, there is provided a method of manufacturing a panel, the panel for building a play area, the method comprising: providing a panel comprising at least one housing portion; and securing at least one magnet in the at least one housing portion such that the at least one magnet can rotate in the at least one recess; and wherein the at least one magnet comprises at least one cylindrical magnet, the at least one cylindrical magnet being diametrically magnetized.

In a fourth aspect there is provided a system for building a play area comprising: two or more panels, each of the two or more panels comprising: at least one recess in at least one edge of the panel; and at least one magnet positioned in the at least one recess such that the at least one magnet can rotate; and wherein each of the two or more panels are configured such that when the at least one edge of the first panel is brought towards the at least one edge of the second panel from any direction, the at least one magnet in each panel orientate such that a magnetic connection is formed between the two or more panels.

According to some examples, the at least one magnet is positioned in the at least one recess such that the at least one magnet can freely rotate.

According to some examples, the at least one magnet in each panel will orientate automatically to form a magnetic bond with at least one magnet in the other panel.

According to some examples, the at least one magnet comprises at least one spherical magnet.

According to some examples, the at least one recess is shaped to house an outer profile of the at least one magnet.

According to some examples, the system comprises at least one safety clip for encapsulating the at least one magnet, wherein when the magnet is removed from the at least one recess the magnet remains encapsulated in the safety clip.

According to some examples, the system comprises at least one board configured to be connected to the at least one panel, wherein the at least one board can be used to display at least one image.

According to some examples, a face of the at least one panel comprises at least one magnet and the at least one board can be connected to the at least one magnet to position the at least one board on the at least one panel.

According to some examples, the at least one board comprises a magnet and/or a metallic section to connect to the at least one magnet of the face of the at least one panel.

According to some examples, the at least one board can comprise a backdrop.

According to some examples, the at least one board can comprise a drawing.

According to some examples, at least one panel comprises at least one of: a triangular panel; a square panel; a rectangular panel; a trapezoid panel.

According to some examples, the at least one panel comprises an aperture which provides a window for the play area.

According to some examples, the play area comprises a structure.

According to some examples, the at least one panel comprises a plurality of panels and the system can be arranged to build the play area, and wherein the play area comprises at least one of: a play house; a stage; a scene; an exhibition display; a play car; a play spaceship; a box; furniture; floor tiles; a floor mat of combined panels; a toy roadway and a stage.

According to some examples, the system comprises layers of the panels; wherein each edge of the panels has a same thickness; and wherein the panels are configured to tesselate with each other such that the layers of panels can be stacked on top of each other for storage. According to some examples, at least one recess is covered to retain the at least one magnet in the at least one recess.

According to some examples, the at least one recess comprises two or more recesses, and wherein each recess is uniformly spaced apart along the at least one edge.

According to some examples, the system is configured to be secured to at least one external object in an environment surrounding the system.

According to some examples, the at least one panel is configured to be secured to the at least one external object.

According to some examples, the at least one panel is configured to be magnetically secured to the at least one external object.

According to some examples, when the panels are stacked on top of each other, the at least one magnet of each panel secures the panels to each other.

According to some examples, the at least one magnet is configured to provide a clicking noise when magnetically attaching to another magnet to indicate the magnetic attachment was successful.

According to some examples, the system comprises a foldable panel with pre-created foldable lines which can be folded to provide different shapes of the foldable panel, and wherein the foldable panel can be magnetically attached to the at least one magnet.

According to some examples, the foldable panel is configured to be secured to at least one external object.

According to some examples, the foldable panel can be magnetically attached to at least one panel of the two or more panels to form a roof and/or a door for the play area.

According to some examples, the foldable panel comprises a blanket attachment.

According to some examples, the system may comprise magnetic accessories that can be added to the at least one panel for decorative or functional use.

According to some examples, the magnetic accessories may include at least one of: lighting equipment; decorative toys; furniture; equipment for hanging drawings.

According to some examples, the system may be combined with a further similar system comprising magnetic panels to create a structure.

According to a fifth aspect there is provided a panel for building a play area comprising: at least one recess in at least one edge of the panel; and at least one magnet positioned in the at least one recess such that the at least one magnet can rotate.

According to some examples, the at least one magnet is positioned in the at least one recess such that the at least one magnet can freely rotate.

According to some examples, the at least one magnet in each panel will orientate automatically to form a magnetic bond with at least one magnet in the other panel.

According to some examples, the panel is configured to magnetically attach to a blanket attachment using the at least one magnet.

According to some examples, the at least one magnet comprises at least one spherical magnet.

According to some examples, the panel is configured such that the at least one magnet in the panel can orientate to align with a magnetic field of a magnet in a second panel when the panel is pushed towards the second panel.

According to some examples, the at least one recess is shaped to conform to the outer profile of the at least one magnet.

According to some examples, the panel is configured to engage with at least one safety clip for encapsulating the at least one magnet, wherein when the magnet is removed from the at least one recess the magnet remains encapsulated in the safety clip.

According to some examples, the panel is configured to be magnetically secured to the at least one external object.

According to some examples, the panel comprises a face, the face comprising at least one magnet for attaching at least one board, wherein the at least one board can be used to display at least one image.

According to some examples, a face of the panel comprises at least one magnet and the at least one board can be connected to the at least one magnet to position the at least one board on the at least one panel.

According to some examples, the at least one board comprises a magnet to connect to the at least one magnet of the face of the at least one panel.

According to some examples, the at least one board can comprise a backdrop.

According to some examples, the at least one board can comprise a drawing.

According to some examples, the panel comprises at least one of: a triangular panel; a square panel; a rectangular panel; a trapezoid panel; a hexagonal panel.

According to some examples, the panel comprises an aperture which provides a window, an entrance and/or an exit for the play area.

According to some examples, the play area comprises a structure.

According to some examples, the play area comprises at least one of: a play house; a stage; a scene; an exhibition display; a play car; a play spaceship; a box; a stage; furniture; floor tiles; a floor mat of combined panels; a toy roadway.

According to some examples, when the panel is configured to be are stacked on top of other panels other and the at least one magnet of each panel secures the panel the other panels.

According to some examples, the at least one magnet is configured to provide a clicking noise signal when magnetically attaching to another magnet to indicate the magnetically attaching was successful.

According to some examples, the at least one recess is covered to retain the magnet in the at least one recess.

According to some examples, the panel can be magnetically attached to a blanket attachment.

According to some examples, the at least one recess comprises two or more recesses and each recess is uniformly spaced apart along the at least one edge.

According to some examples, the panel can be secured to an external object.

According to some examples, the panel can be magnetically secured to the external object.

According to some examples, the panel can be stacked with other panels and the at least one magnet may secure the panel to the other panels.

According to some examples, the at least one magnet is configured to provide a clicking noise when magnetically attaching to another magnet to indicate the magnetic attachment was successful.

According to a sixth aspect there is provided a method of manufacturing a panel, the panel for building a play area, the method comprising: providing a panel comprising at least one recess in at least one edge of the panel; and securing at least one magnet in the at least one recess such that the at least one magnet can rotate in the at least one recess.

DETAILED DESCRIPTION

According to some examples, a panel is provided which can be used with one or more other panels to build a system comprising the panel and the one or more other panels.

According to some examples, a system is provided where a user (such as a child) can use a securing mechanism for panels for a building child's play area easily. According to some examples, a user such as a child is only required to hold two panels together to secure them together. The panels can then connect and secure to one another using a self-aligning magnet system as described below. This provides a simple mechanism for children to build play structures.

According to examples, the system comprising one or more panels may be used as a play area. The play area could be used, for example, for children to play with. Examples of a play area include, but are not limited to: a play house; a stage; a scene; a fort; an exhibition display; a play car; a play spaceship; furniture; floor tiles; a floor mat of combined panels; a toy roadway; and a box. The play area may comprise a self-standing structure. In some examples, the structure is a size in which children can enter and exit the structure and play with or within the structure. In other words, the structure may be "child-sized" and in some cases, depending on what is built using the system, may be "life-sized". In some examples, the structure is between 0.5 m to 2.5 m tall.

In some examples, the system comprising the one or more panels may be considered to comprise a modular construction unit. The modular construction unit may comprise at least one module. The at least one module may comprise: at least one panel and/or at least one attachment.

The system may comprise panels having different shapes. As shown at 101*a* of FIG. 1A, a panel may have a square shape. As shown at 103*a* of FIG. 1A, the panel may have a trapezium shape. As shown at 105*a* of FIG. 1A, the panel may have a triangle shape. In some examples, the panels may comprise connectors and dowels that are used to form the panel shapes.

Figure 1A:
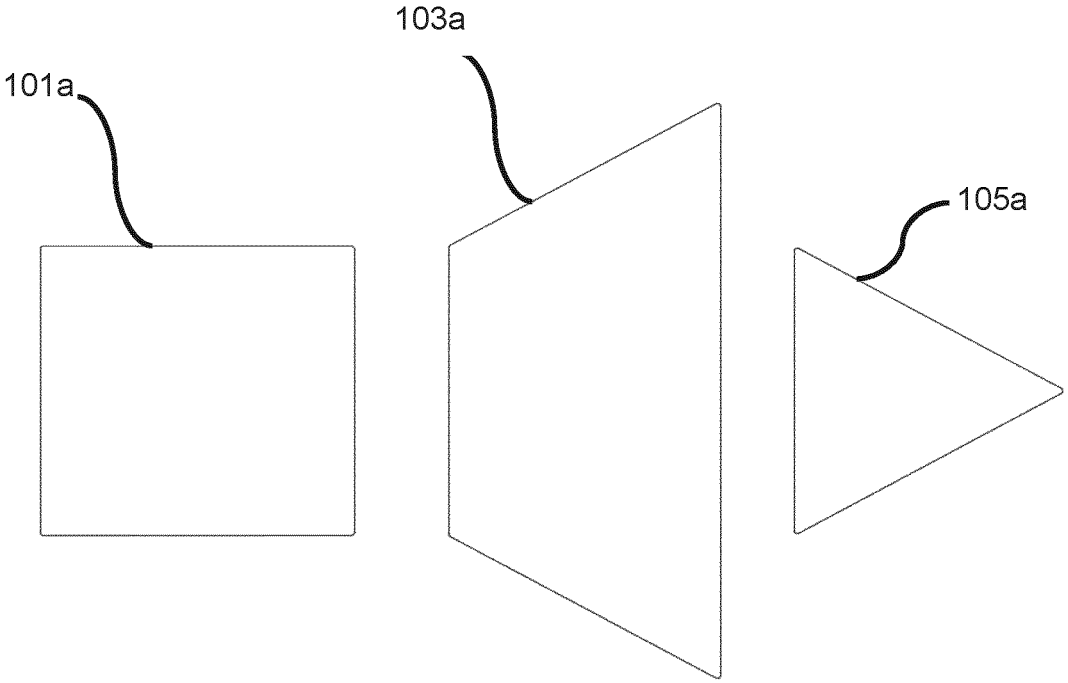
FIG. 1A shows a first example of panels of a system from a first perspective.

According to some examples, a panel may have a shape other than the shapes shown in FIG. 1A, such as a rectangle or a rhombus shape, for example. In some examples the panel may be any shape of polygon. In some examples the panel may have one or more curved sides. In some examples, the panel may be circular.

Figure 1B:
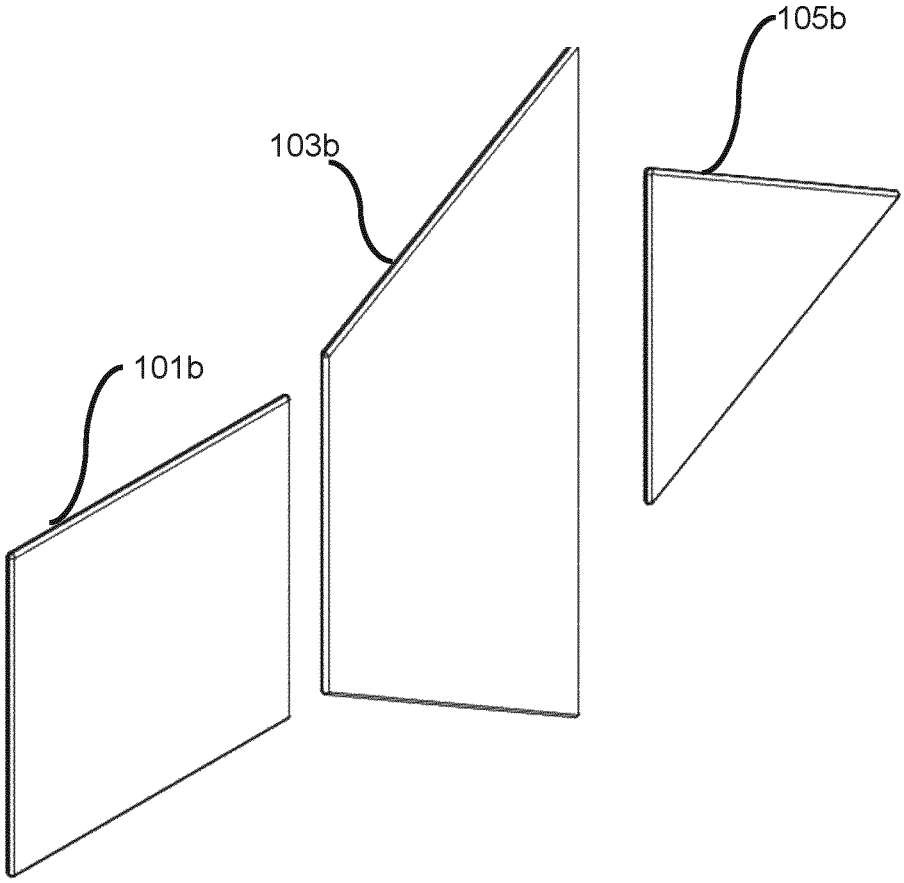
FIG. 1B shows the first example of panels of the system from a second perspective.

In some examples, each panel may have width and length dimensions that are substantially larger than a thickness of the panel. This is shown in FIG. 1B, which shows the panels as viewed from an angle that does not coincide with the plane defined by the length and width of the panels 101*b*,

103*b* and 105*b*. In other words, FIG. 1B shows a view where the panels are not viewed "head-on". As such, in FIG. 1B the thickness of panels 101*b*, 103*b* and 105*b* is also visible as well as the length and width of each panel. It can be seen in FIG. 1B that the thickness of panels 101*b*, 103*b* and 105*b* is less than the length and width.

According to some examples, each panel of the system may have the same thickness. This can be useful for uniformity when stacking panels on top of each other, and also for providing uniformity when placing the stacks of panels alongside one another.

In some examples, the shapes of the panels are configured to tesselate with one another to form one larger shape comprising multiple panels. The larger shapes comprising multiple panels can then be stacked on top of each other for storage. It can be particularly useful for the panels to have a uniform thickness in this example, to provide uniformity between layers of panels.

The panels can be made of a material which is firm enough to hold the panel up such that the panel will not collapse when a child builds a structure or goes inside the structure. For example, the panel may be made of foam. The foam may be firm and/or dense. The panel may also be made of lightweight plastic or any other suitable material. In some examples, the panels may be formed by gluing foams of varying rigidity together to achieve a desired strength. In some examples, the panels may be built of foam and fabric. In other examples, the panel may be formed from an injection moulded plastic or foam. In some examples, the panel may be formed by thermo compression moulding. In some examples, the panels may be coated. For example, a panel may have a foam inner and a plastic coating. In some examples, the panel may have a fabric covering. In some examples, the panel may be formed of a foam core that is stiffened using a thermo moulding technique.

In some examples, the panel may be made of fabric having sleeves through which dowels are passed through. The dowels may be connected using connectors.

In examples, the system of panels has an 'any way' connection mechanism that is built on or in each panel. In some examples, the connection mechanism is considered to be internal to each panel, or at least partially internal to each panel. In some examples, the connection mechanism is considered to be integrated in to each panel. In some examples, the connection mechanism is considered to be automatic. This automatic connection mechanism is discussed further below. The system allows a user, such as a child, to easily connect any two or more panels by touching them together. In some examples, it does not matter which way the child tries to connect the panels, the panels will stick to each other. This is to make it as simple and easy as possible for children to create a play space. This provides an advantage over other connection methods in other products as the connection method is less confusing and frustrating, which can be particularly useful when a user is a child.

In some examples, the connection mechanism is incorporated inside of connectors used to connect dowels. In some examples, the connection mechanism uses cylindrical diametric magnets.

In some examples, the connection mechanism is used not only for the panels but also in other modules such as attachments, for example in a blanket attachment or foldable panel attachment or other accessories used for decoration or added utility. These attachments are discussed further below. The attachments may comprise, for example, spotlight add-ons, decoration accessories or accessories for hanging pictures (e.g. a hook). The magnetic connection mechanism can also be used so that panels from one set of panels can be combined with panels from another set and therefore form even larger structures.

Figure 2:
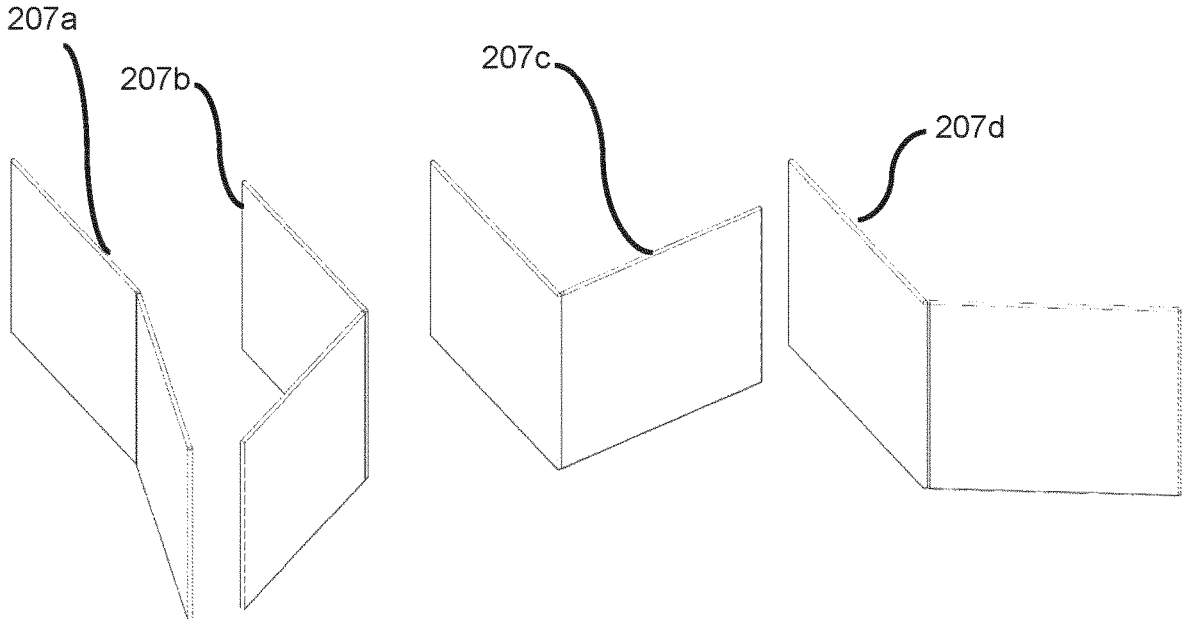
FIG. 2 shows a second example of panels connected in the system.

FIG. 2 shows examples of positions in which two panels may be positioned once they have been attached to each other by the connection mechanism. As can be seen in FIGS. 2 at 207*a*, 207*b*, 207*c* and 207*d*, the angle between two panels once connected can be varied to provide a user with different options as to how the panels can be orientated. The position of the panels can be varied such that the largest angle between them is anywhere between 0 and 180 degrees.

It can be seen in FIG. 2 that two panels can be connected at their respective edges. These edges then form a hinge which the panels can be rotated around.

Although FIG. 2 only shows a situation in which two rectangular panels are attached, it will be understood that the angle between two panels can also be varied when the panels have any other shape.

In some examples, the connection mechanism comprises magnets positioned in the edges of the panels. The magnets can be used to form the connection mechanism. In some examples, the magnets comprise spherical magnets (ball magnets). In some examples, the magnets comprise cylindrical diametric magnets.

Figure 3:
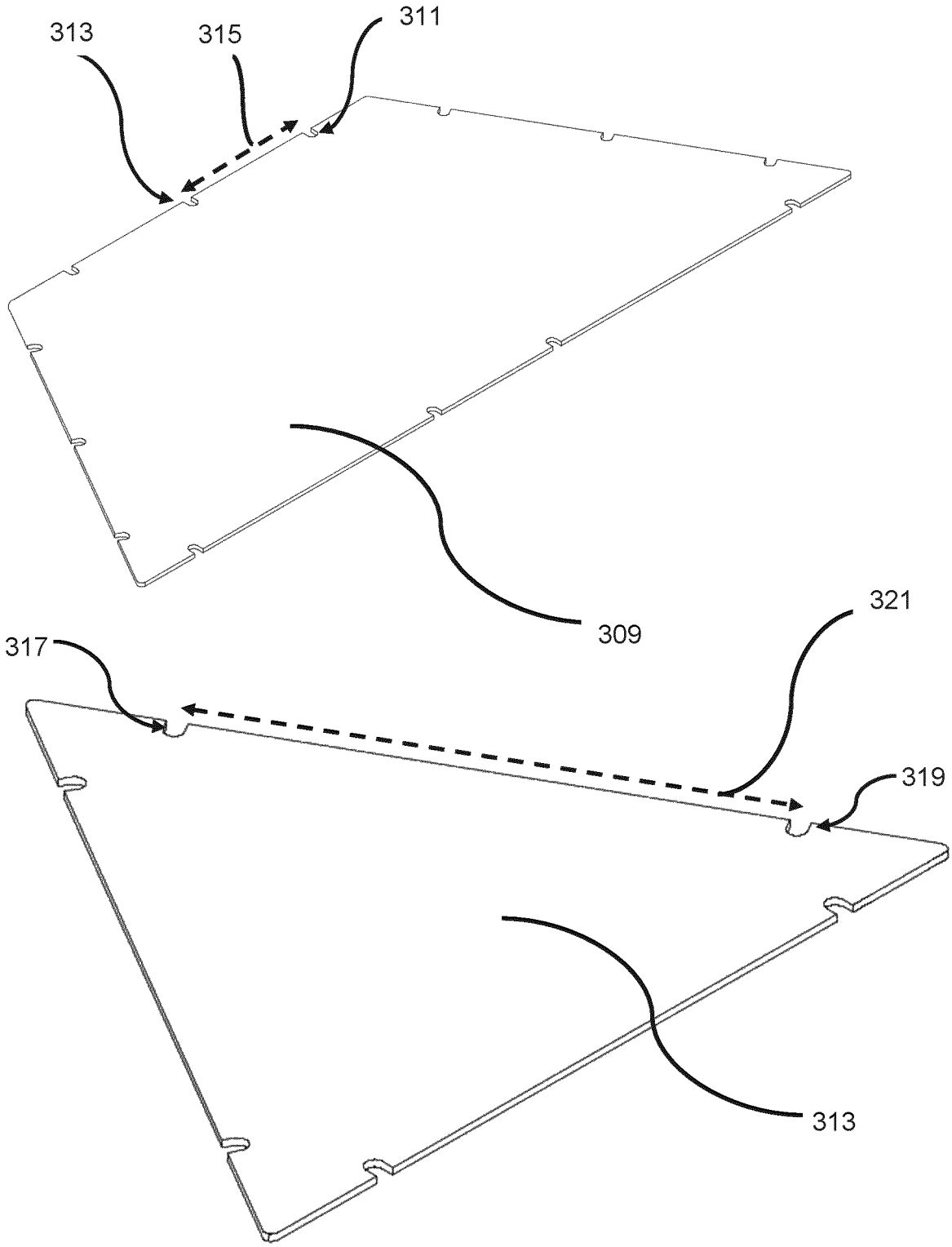
FIG. 3 shows a third example of panels of the system.

FIG. 3 shows examples of how recesses may be positioned in a panel to house the magnets of the connection mechanism. Each panel may comprise a recess which is shaped to house the outer profile of a magnet. In some examples, each panel comprises one or more recesses which are shaped to house one or more respective magnets. A recess (hole) in which a magnet is housed may be shaped such that the recess is slightly bigger than the magnet. As such, the magnet may be held in the recess in a way in which the magnet can re-orientate when an external force is applied to the magnet. In some examples, the external force may comprise a magnetic force.

In some examples, where the magnet is a spherical magnet, the spherical magnet may be held in a partially spherical recess or hemispherical recess. The recess may have a radius slightly larger than the spherical magnet. As an example, the spherical magnet may have a radius of 10 mm and the recess may have a radius of 11 mm. Of course, in other examples different dimensions may be provided.

Two recesses 311 and 313 of trapezium panel 309 and two recesses 317 and 319 of triangle panel 319 are shown in FIG. 3. Other unlabelled recesses are also shown for each panel.

Recesses 311 and 313 may be separated by a distance 315 along an edge of panel 309. In some examples, the distance between each consecutive recess along each edge of panel 309 is the same as distance 315, such that the recesses are uniformly spaced along the edge which they are positioned on.

Recesses 317 and 319 may be separated by a distance 321 along an edge of panel 313. In some examples, the distance between each consecutive recess along each edge 313 is the same as distance 321, such that the recesses are uniformly spaced along the edge which they are positioned on.

In examples where panels 309 and 313 are in the same system, spacing 315 may be the same as spacing 321. In such examples, the magnets are positioned in recesses with a uniform spacing along an edge of a panel between each magnet (as an example for the purpose of illustration only, each magnet may be positioned 0.30 m apart and there may be several magnets along one edge of a panel). This allows the magnets of each panel to coincide with each other when two panels are placed alongside one another.

In examples, for panels which are the same shape and which are a part of the same system, the recesses may be positioned in the same position on each panel.

Figure 4:
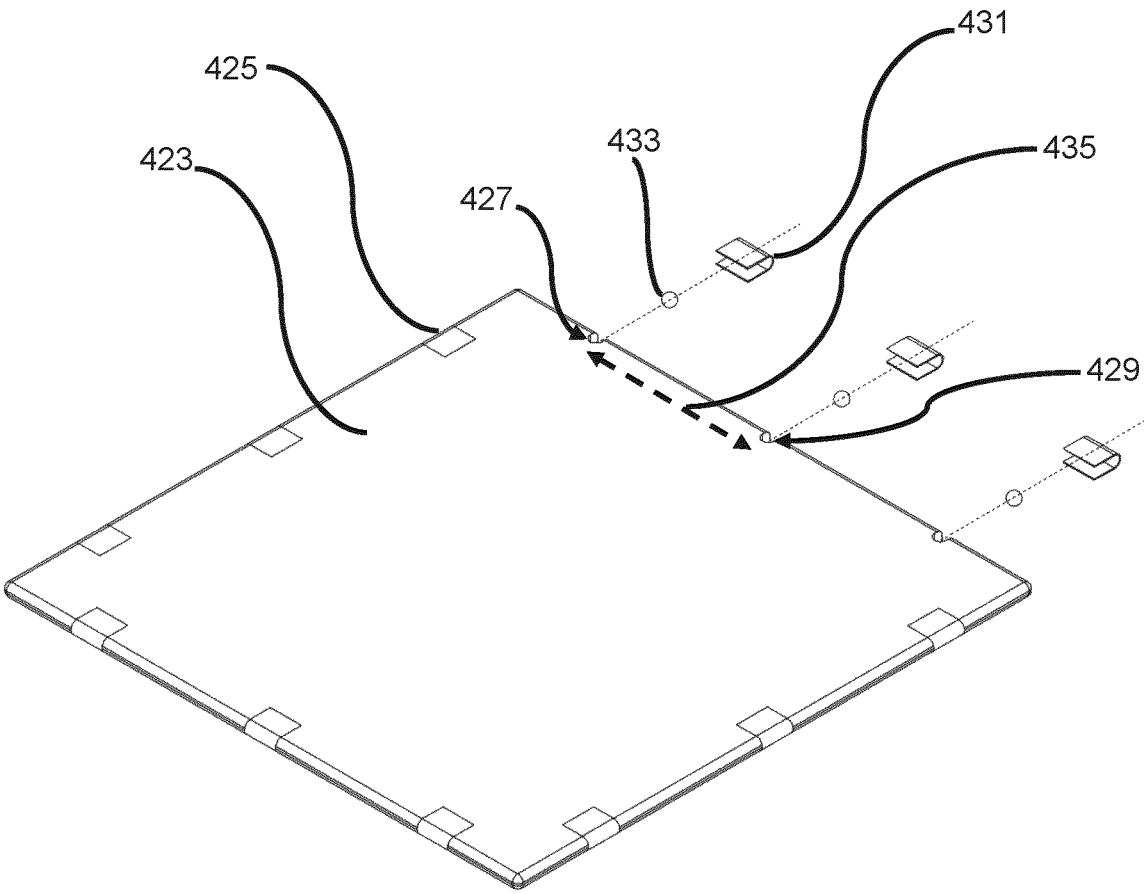
FIG. 4 shows a fourth examples of panels of the system.

FIG. 4 shows an example of how a magnet 433 may be secured in a recess 427 by securing means 431 in a panel 423. Securing means 431 may comprise a casing or a lid that is placed over recess 427 so that magnet 433 stays in recess 427. The securing means 431 may be glued over recess 427, for example. Alternatively, the securing means 431 may be a push-fit or a friction-fit over the panel 423. In other examples, recess 427 may be sewn over with fabric, such that securing means 431 comprises fabric. In some examples, recess 427 may be taped over such that securing means 431 comprises tape. In some examples, magnet 433 may have special casings which are created to house the magnets and then glued into place, such that the magnet is encased in a securing means and then glued into place in the panel. These casings and other casings, both of which may comprise safety clips, are discussed further below.

In some examples, each of the magnets (e.g., magnet 433) of panel 423 may comprise a diametric cylindrical magnet, and each of the recesses (e.g. recesses 427, 429) may be shaped to house a diametric cylindrical magnet. Any other suitable shape of magnet may be used. In some examples the recesses are positioned in the corners of panel 423. Each corner of panel 423 may comprise two recesses housing magnets, such that a magnet is provided on each edge at each corner. There may be provided a system of panels such as panel 423, the panels having any shape discussed herein. The panel may be made of PET, foam or any other suitable material.

Magnet 433 and the other magnets of FIG. 4 may be any suitable shape. In some examples, as shown in FIG. 4, magnet 433 and the other magnets of FIG. 4 may be spherical magnets. In some examples, magnet 433 and the other magnets of FIG. 4 may be diametric cylindrical magnets. One or more magnets may be positioned along the edges of each panel as shown in FIG. 4. In other examples, one or more magnets may be positioned in corners of each panel as discussed in the above paragraph. In a further example, a panel may comprise one or more magnets positioned along an edge of a panel and also one or more magnets positioned at corners of each panel.

In some examples, each magnet of panel 423 may be positioned such that they can rotate. It will be noted that in some embodiments, one or more magnets (potentially all of the magnets of panel 423) are positioned such that they cannot rotate.

Figure 18:
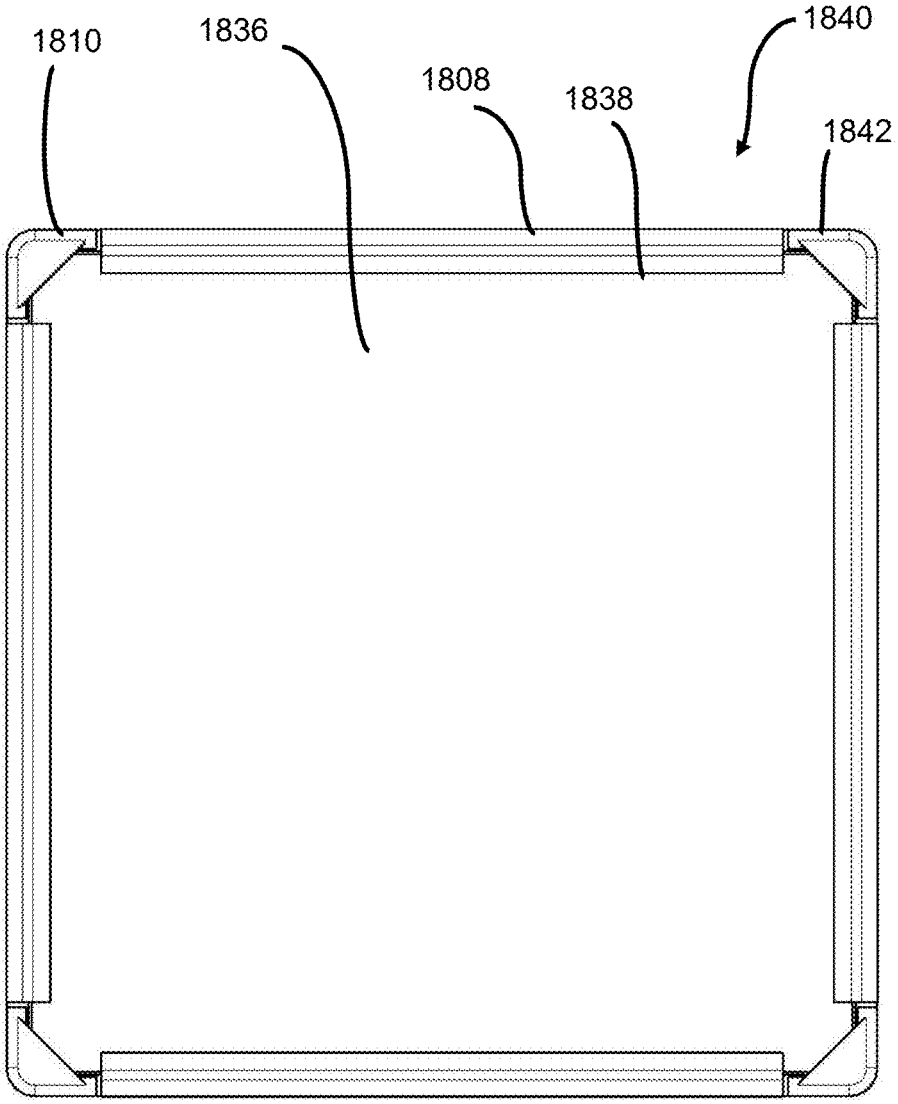
FIG. 18 shows an example part of the system.

In contrast to the panel of FIG. 18, which comprises a frame, the panel of FIG. 4 may be considered to be "frameless", i.e., not comprise a frame.

Recesses 427 and 429 may be separated by a distance 435. A magnet may be retained in recess 429 using a securing means similar to securing means 431. In some examples, each recess of panel 423 has a magnet retained within the recess using a securing means similar to securing means 431.

Securing means 431 may be similar to the safety clip described below with respect to FIGS. 10 and 11.

Panel 423 also shows a magnet 433 retained in a securing means 425.

Recesses 427 and 429 may be separated by a distance 435 along an edge of panel 423. In some examples, the distance between each consecutive recess along each edge of panel 423 is the same as distance 435, such that the recesses are uniformly spaced along the edge they are positioned on.

In examples where panels 309, 313 and 423 are in the same system, spacing 315, spacing 321 and spacing 435 may each be the same.

Although a securing means is shown in FIG. 4, it should be noted that in some examples a securing means is not required to retain a magnet in a recess of a panel, as the recess may be sized only slightly bigger than the magnet such that the magnet is retained in the recess without the requirement of a securing means. For example the magnet may be a loose push-fit in the recess of a panel, so that the magnet is held in place strongly enough to prevent the magnet from falling out of the panel, but loosely enough to enable the magnet to rotate in the recess of the panel.

In some examples, the magnets of panel 433 may not be housed in recesses as shown in FIG. 4 by may instead be held proximate to an edge of the panel using a securing means such as 425. In such an example, the panel may have a similar shape as to any of those shown in FIGS. 1A and 1B. Similarly to above, the magnets in this non-recessed example may be positioned at the corners or a panel and/or along the edge of each panel (away from the corners).

Figure 11:
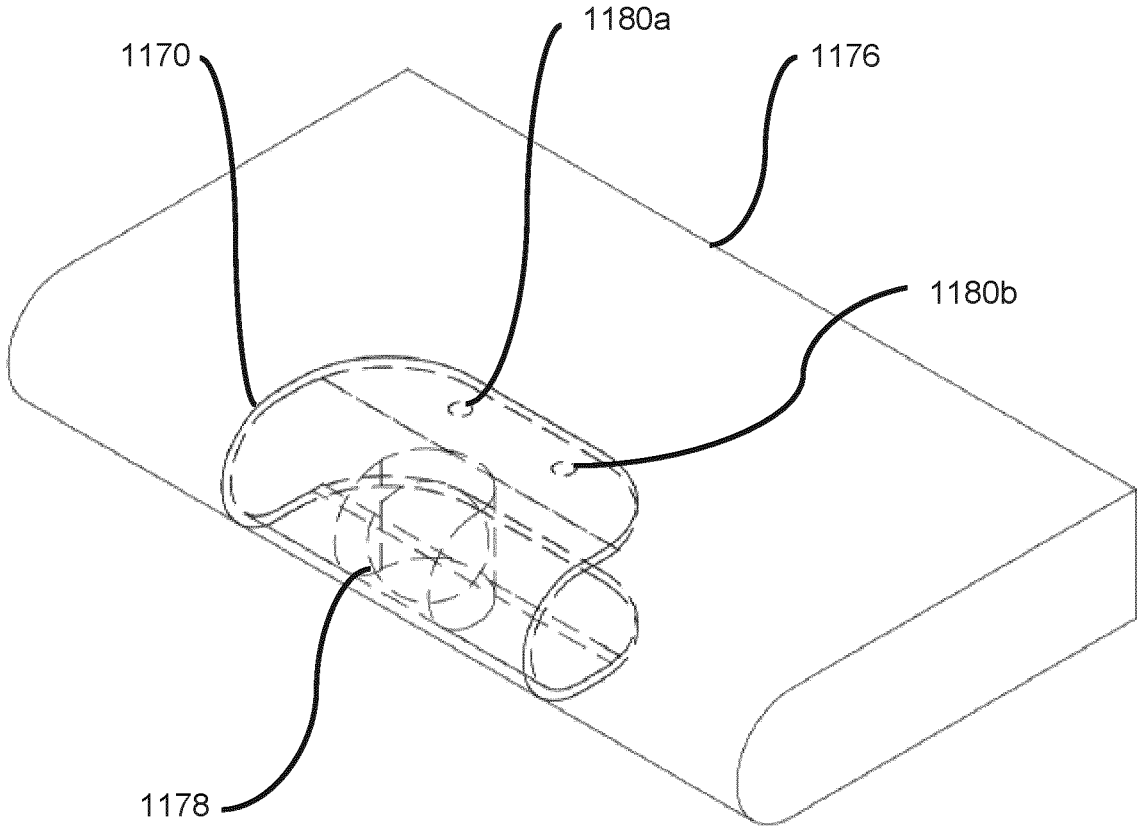
FIG. 11 shows an example part of the system.

In some examples, a clip similar to 1170 shown in FIG. 11 may be attached to a panel. In this example, a recess may not be necessary.

In some examples, a connector such as connector 1310 may be used which is attached to e.g., the corner of a panel such as panel 101*a*, 103*a*, 105*a*, etc. These connectors may house one or two magnets. A recess in the panel may not be necessary when using such connectors.

Figure 5:
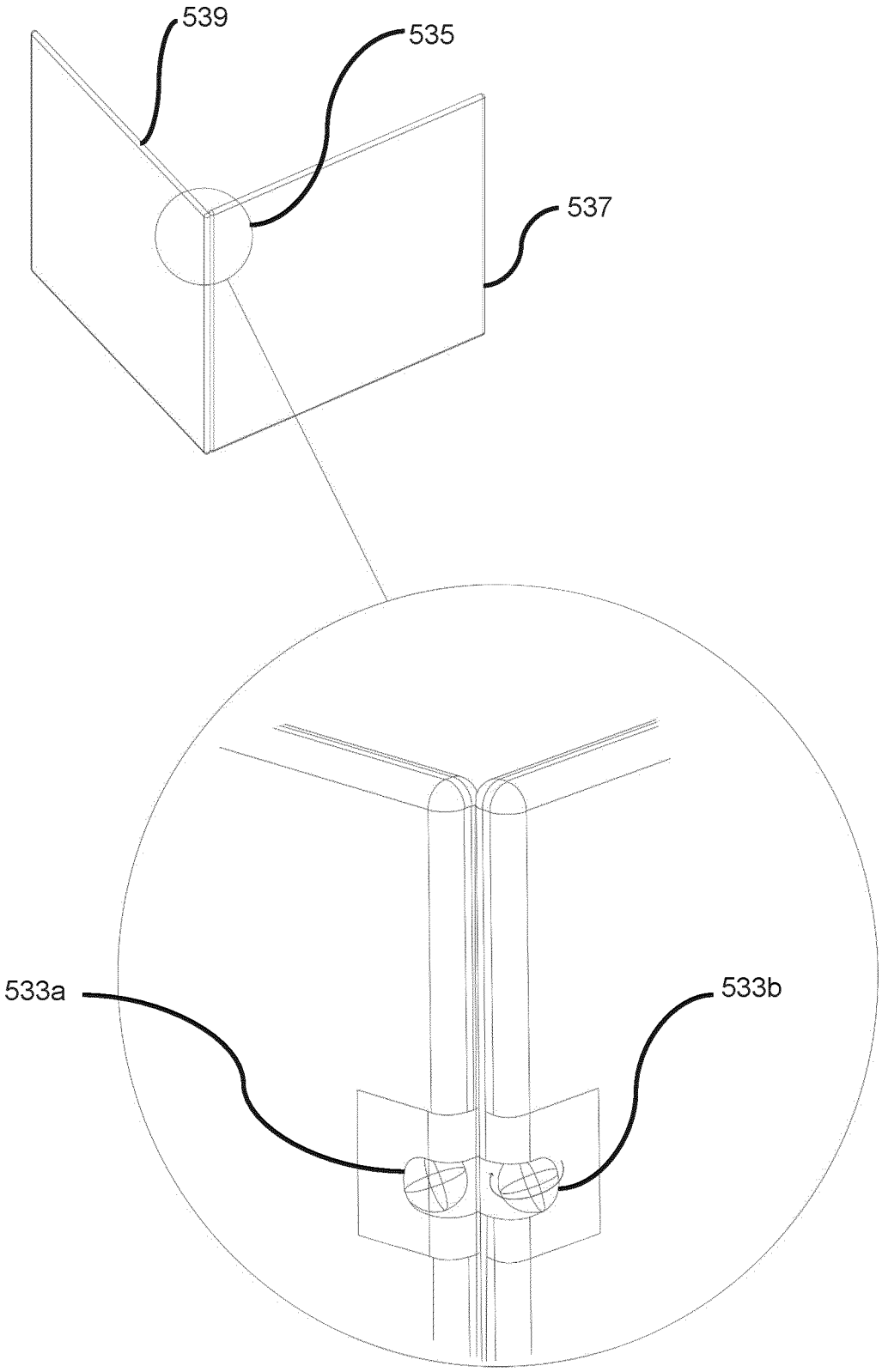
FIG. 5 shows an example of a connection mechanism of the system.

FIG. 5 shows an example of the connection mechanism that can be used to connect modules such as panels or panel attachments together. The exemplary method involves holes (recesses) inside each panel material in which spherical magnets sit. Each spherical magnet has a north and south pole and is able to re-orientate (rotate) when magnetically attracted to another spherical magnet such that the north pole of one spherical magnet is aligned with the south pole of another spherical magnet. The spherical magnets are then attracted towards one another and can hold the panels together.

In some examples, to ensure that a spherical magnet can re-orientate to align with another spherical magnet, the spherical magnet is positioned in a hole (recess) in the panel that is just bigger than the spherical magnet. In some examples, the recess is also shaped to conform to the outer profile of the spherical magnet. This allows the spherical magnet to rotate when re-orientating to align with another spherical magnet. In examples, the recesses may be hemi-spherical or partially spherical and have a radius only slightly larger than the radius of the spherical magnet.

FIG. 5 shows how the connection mechanism works as two panels 539 and 537 are pushed towards each other. A magnification of portion 535 where the two panels meet is shown in FIG. 5. When two magnets 533*a* and 533*b* are urged towards each other by a user who pushes two panels 537 and 539 together, magnets 533*a* and 533*b* are able to re-orientate due to the space provided in each of the recesses holding them. As such, a north pole and a south pole of magnets 533*a* and 533*b* align with one another and the magnets are magnetically attracted towards each other. Therefore, the connection mechanism may be considered automatic, in that the user has not had to directly contact the connection mechanisms in order to fasten two panels together.

As an example, if a north pole of magnet 533*a* is urged towards a north pole of magnet 533*b*, magnet 533*b* may rotate such that the south pole of magnet of magnet 533*b* is closer to magnet 533*a* than the north pole. Magnets 533*a* and 533*b* are then attracted towards each other, and the panels 537 and 539 are connected to each other.

It should be noted that although only one magnet is shown for each panel 539 and 537, more than one magnet may be positioned along the edges of panel 537 and 539, such that there is more than one section for magnetic connection when the two panels 537 and 539 are pushed towards each other.

Another feature of the panel connection system is an automatic and satisfying 'click' noise (i.e. a clicking noise) that the panels make when they connected to each other. This is caused by the magnets being attracted towards one another. This noise makes it easy to combine panels and the click signals to the child that the panels have successfully connected. This helps boost the user's confidence to continue building. This feature can be provided when using spherical magnets or cylindrical diametric magnets, for example.

In some examples, the system can optionally also connect directly to external items made of metal via the magnetic panels in order to enhance a structure e.g. a metal part of a kitchen island. The connection may be made via the magnets of the magnetic panels or the magnets of the attachments. Magnetic clips and lights can also attach to main magnetic panels.

In some examples, the system may also comprise an attachment that is a foldable panel. The foldable panel may be considered to be a "blanket-type panel". This blanket-type panel comprises a panel that is foldable along pre-created fold lines and can therefore conform to multiple shapes. The blanket-type panel may be foldable in a similar method to origami. The blanket-type panel also has magnets as per other panels to connect to other panels and external objects. This can be used to create a roof or a wall or anything else needed to add to the construction of the structure.

Figure 6:
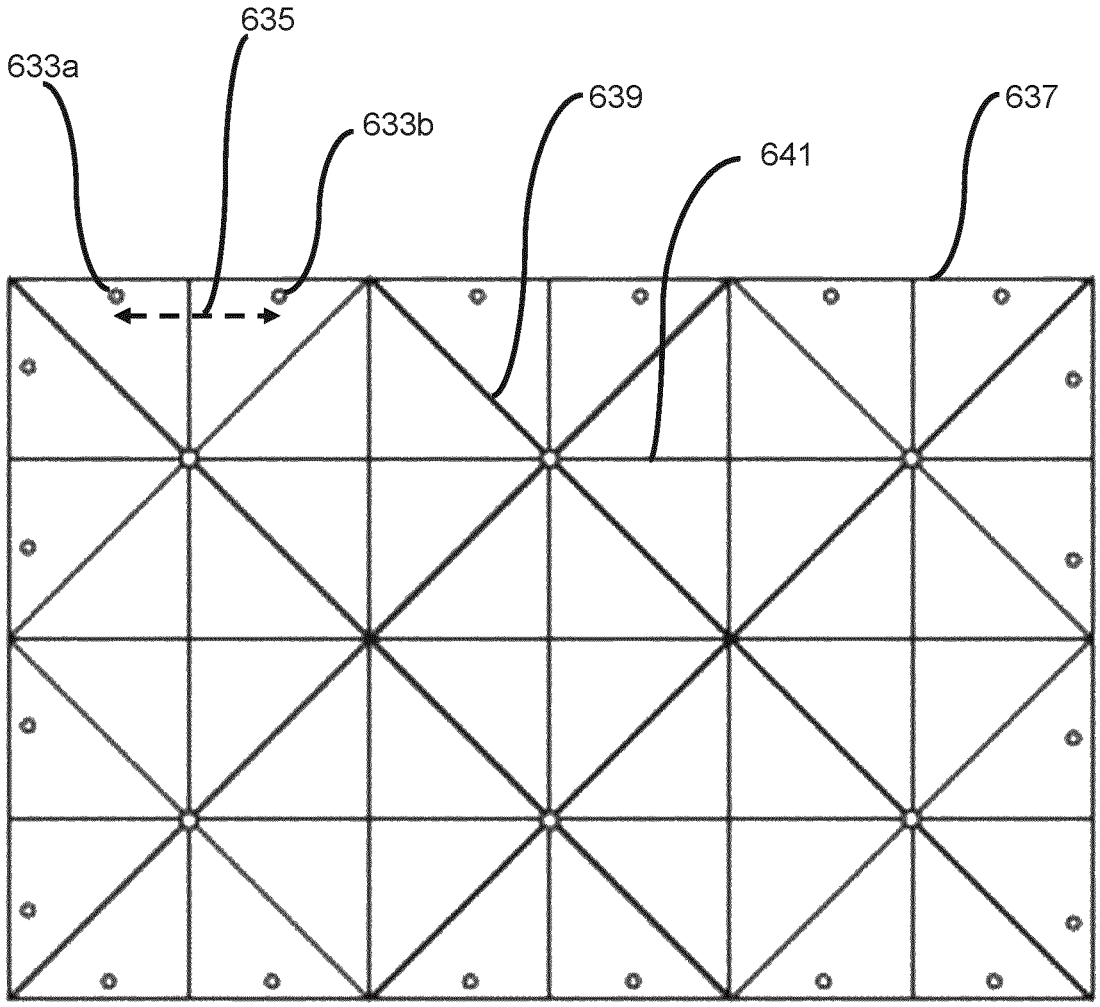
FIG. 6 shows an example of an attachment of the system.

FIG. 6 shows an example of a foldable panel 637. The foldable panel 637 comprises two magnets 633*a* and 633*b* separated by a distance 635. In some examples, magnets 633*a* and 633*b* are spherical. In a system comprising both foldable panel 637 and panels 313 and 309 of FIG. 3, distances 321. 315 and 637 may be the same.

As shown in FIG. 6, foldable panel 637 may comprise magnets other than 633*a* and 633*b*. These magnets may be positioned along each edge of foldable panel 637. In some examples, the spacing between each consecutive magnet along an edge of a panel may be equal to distance 635.

In the example of FIG. 6, the lines shown inside of the edge of panel 637 show an example pattern of pre created fold lines. Such lines are labelled at 639 and 641. A user can fold and unfold the panel 637 to create a desired shape of a structure.

Figure 7:
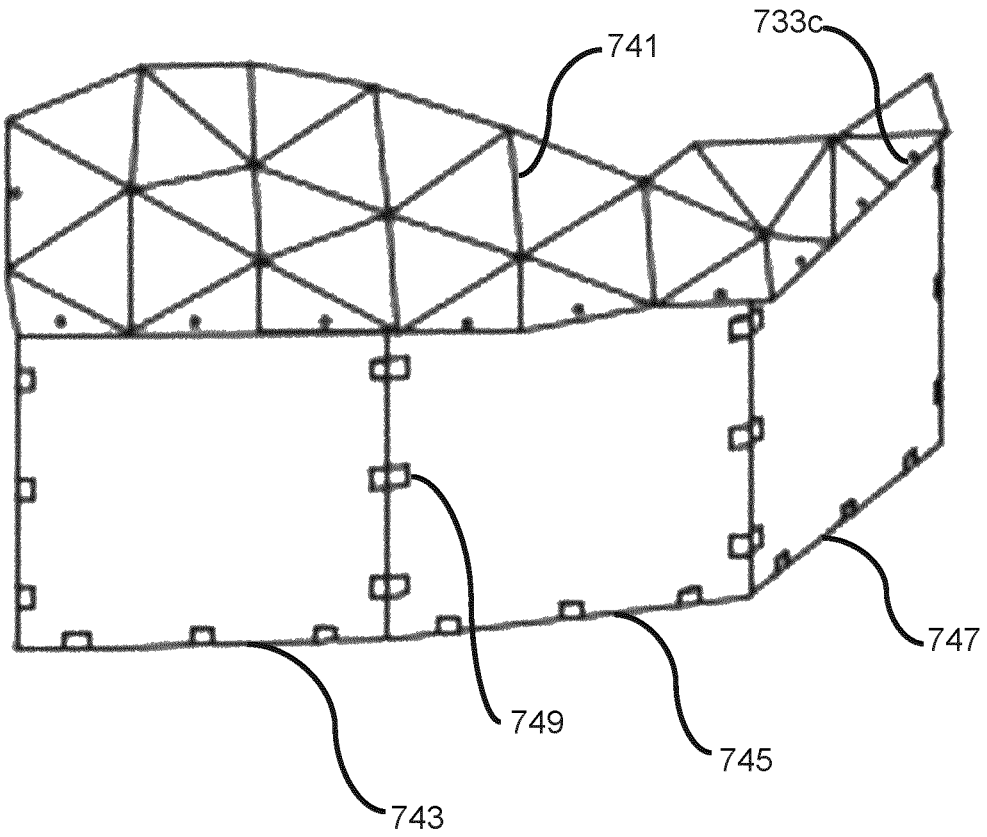
FIG. 7 shows an example structure of the system.

FIG. 7 shows a structure comprising three panels 743, 745 and 747 and a foldable panel 741. Panels 743, 745 and 747 may be connected using the magnetic connection method discussed above, or by using the cylindrical magnet connection method described below. The top edges of the panels 743, 745 and 747 are then connected also using the magnetic connection method to foldable panel 741. A magnetic connection point 733*c* between panel 747 and foldable panel 741 is also labelled for illustration. A magnetic connection point 749 is also shown between panels 745 and 743. It will be clear that other magnetic connection points may also provided as shown in FIG. 7.

In some examples, the system unit also has blanket attachments that attach to the magnets anywhere on the panels to enhance the built structure and can act as anything from a doorway to an awning or extra roof section. The at least one module of the system may comprise a blanket attachment. In some examples, the blanket attachments are magnetic and can be magnetically attached to one or more magnets of a panel. In some examples, the blanket is made of a more flexible material than the panels. The blanket could be made of a more lightweight foam so it could easily form a roof or door of a structure. The blanket could also be used as a tunnel between fort structures or a mat. The blanket could be used to provide a roof and/or door a child's play area.

Figure 8:
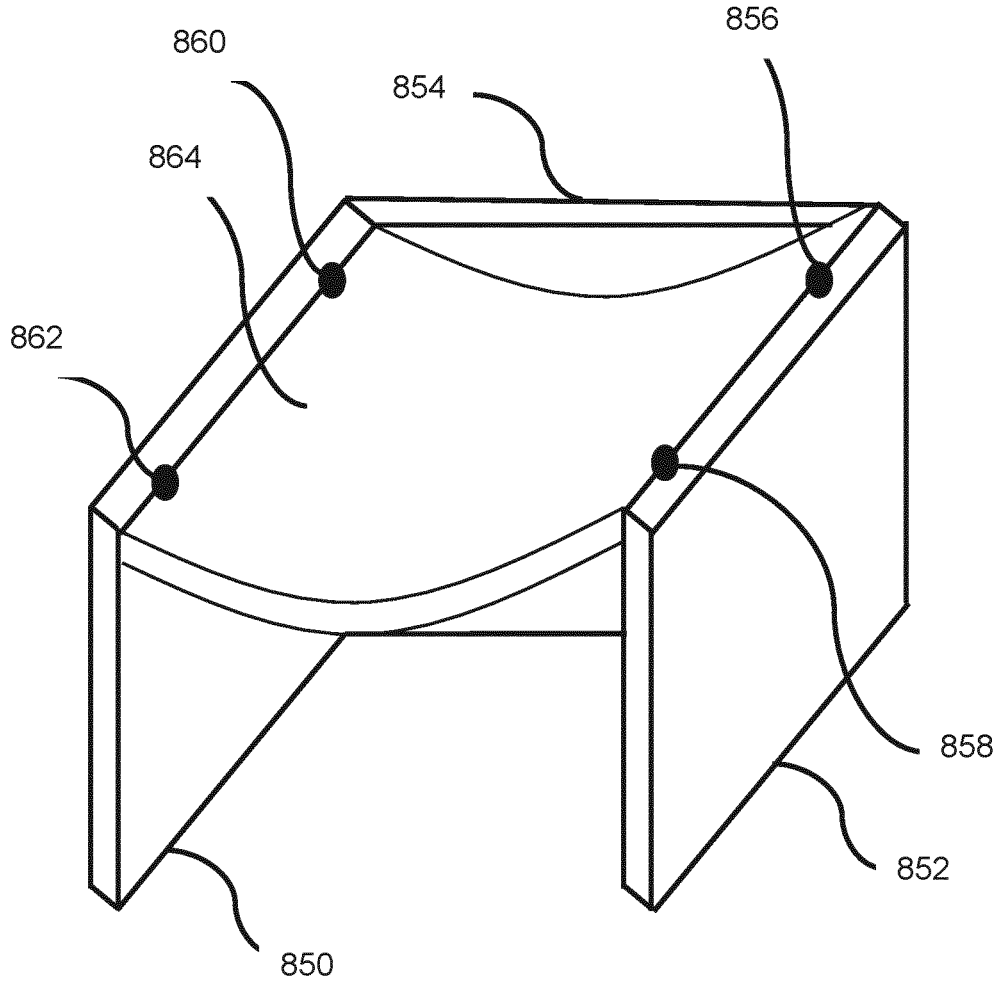
FIG. 8 shows a second example structure of the system.

FIG. 8 shows an example of a blanket attachment 864 attached to an exemplary structure comprising panels 850, 852 and 854. In the example, the blanket attachment is connected at connection points 856 and 858 to panel 852. The blanket attachment is also connected at connection points 860 and 862 to panel 850. It will be understood that although only two connection points are shown for each of panels 850 and 852, there could be a different number of connection points on panel 862 or 860 in some examples. Furthermore, it will be understood that although no connection points between the blanket attachment 864 and panel 854 are shown in the example of FIG. 8, in some examples blanket attachment 864 may also be attached to panel 854 at one or more connection points.

In some examples such as the example of FIG. 8, the central portion of blanket attachment 864 is lower in the centre than at the edges of the blanket attachment. This can be caused due the flexible material of the blanket attachment. If the distance between panels 850 and 852 was to be increased, the central portion of blanket 864 would be raised. Conversely, if the distance between panels 850 and 852 was to be decreased, the central portion of blanket 864 would be lowered.

In some examples, the connection points 856, 858, 860 and 862 may comprise connections made using the connection mechanism formed by spherical magnets housed inside the panels 852 and 850. In some examples, the connection points 856, 858, 860 and 862 may comprise connections made using the connection mechanism formed by cylindrical diametric magnets housed inside the panels 852 and 850. In some examples, the connection points 856, 858, 860 and 862 may comprise connections made using magnets housed inside blanket attachment 864. In some examples the magnets housed inside the blanket attachment 864 may be spherical. In some examples the magnets housed inside the blanket attachment 864 may be cylindrical, and in some examples the magnets house inside the blanket attachment may be diametric. In some examples the magnets housed inside the blanket attachment may attach to magnets housed inside the panels. The magnets housed inside the blanket attachment may have a similar spacing between one another along each edge of the blanket attachment. The magnets house inside the blanket attachment may have a similar spacing to magnets housed inside the panels.

In some examples, blanket attachment 864 may be made of a magnetic material such that the blanket attachment can be magnetically attached to magnets house inside the panels of the system, such as panel 850, 852 and/or panel 854.

Figure 9:
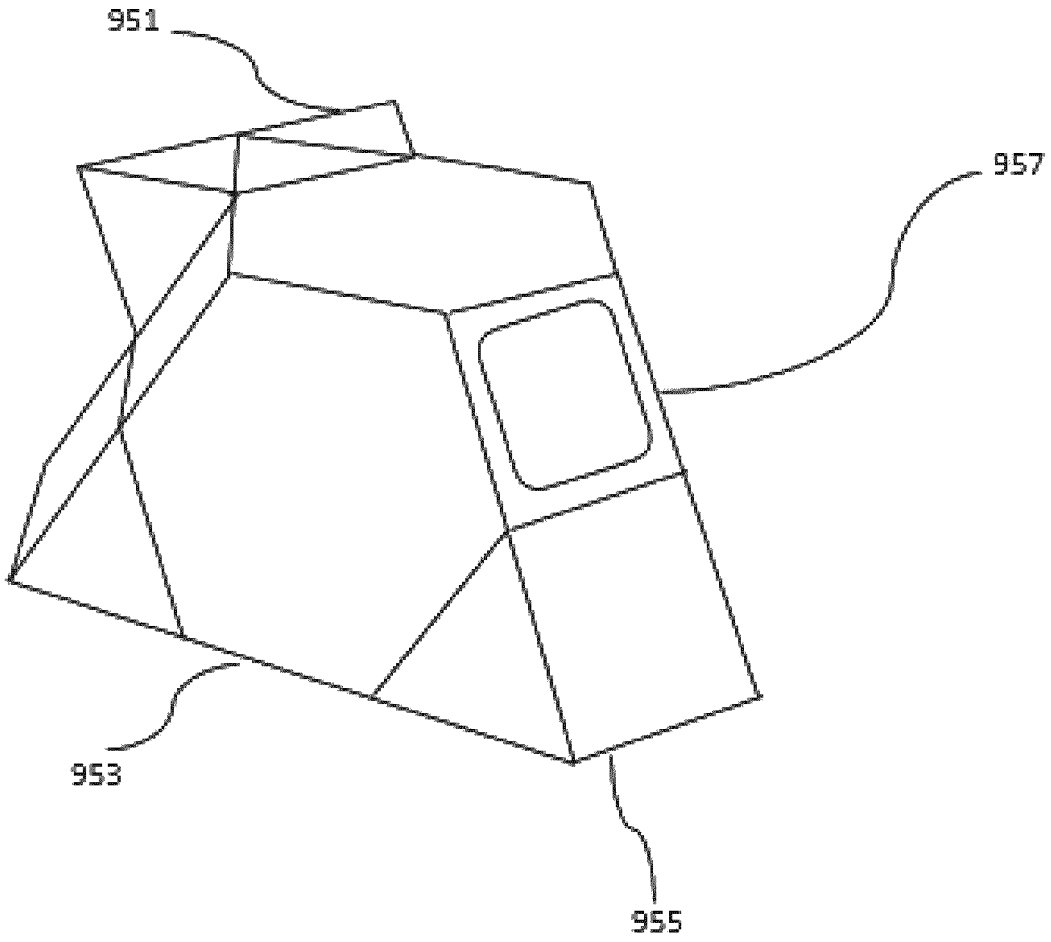
FIG. 9 shows a third example structure of the system.

FIG. 9 shows an example of a structure that could be formed by a user using the system. Module 955 comprises a rectangular panel. Module 953 comprises a hexagonal panel. Module 951 comprises a triangular panel. Module 957 comprises a rectangular panel having an aperture. Although an aperture is only shown in the rectangular panel, it will be understood that any shape of panel could be provided with an aperture. The aperture could be used to provide a window for a child's play area.

According to some examples a child could assemble the structure of FIG. 9 using the system's connection method. The system could use spherical magnets and/or cylindrical diametric magnets as described further below. As the magnets can re-orientate when they are urged together, a user such as a child can easily assemble the structure by simply pushing the panels together from any direction. The user can then use the structure, which can form a child's play area.

According to some examples, each panel of the system may have the same thickness. In some examples, different shapes of the panels can be tessellated together to form a larger shape when put together on the same plane. Layers of planes of one or more panels can then be stacked on top of each other for storage purposes. The at least one magnet of each panel can then be used to secure the panels to each other within each plane. The at least one magnet can also be used to secure the panels from different planes to each other.

According to some examples, the system comprises at least one board that can be connected to a module of the system. For example, the at least one board may be connected to at least one panel of the system. The at least one board can be used by a user to display pictures, for example to decorate a play area formed by the system.

In some examples, a board may comprise a magnet, such as a magnetic strip. Using the magnet of the board, the board can be connected to a panel of the system. The magnet of a board can be connected to one or more magnets of a panel of a system. The magnets of the panel of the system may comprise a spherical magnet of the automatic connection mechanism discussed above that can additionally be used to connect to the magnetic strip of a board. The magnets of the panel of the system may comprise a cylindrical diametric magnet of the automatic connection mechanism as discussed below that can additionally be used to connect to the magnetic strip of a board. In some examples, panels of the system may comprise a magnetic strip provided on a face of a panel, which can be used to magnetically attach a board to the panel using a magnetic strip of the board.

According to some examples, the attachable boards for the system may comprise a backdrop, for example, a scene used in a play. In other examples, the attachable board may comprise a drawing of a user, or a canvas upon which the user can draw. The attachable boards can be used to create "themes" for a play area.

In some examples, the system can also be used to provide storage for objects such as children's toys. The modular system can be rearranged from a life-size play area such as: a play house; a stage; a scene; a fort; an exhibition display; a play car; a play spaceship; and/or a box to a toy box. The toy box can then be used to store objects such as toys.

Figure 10:
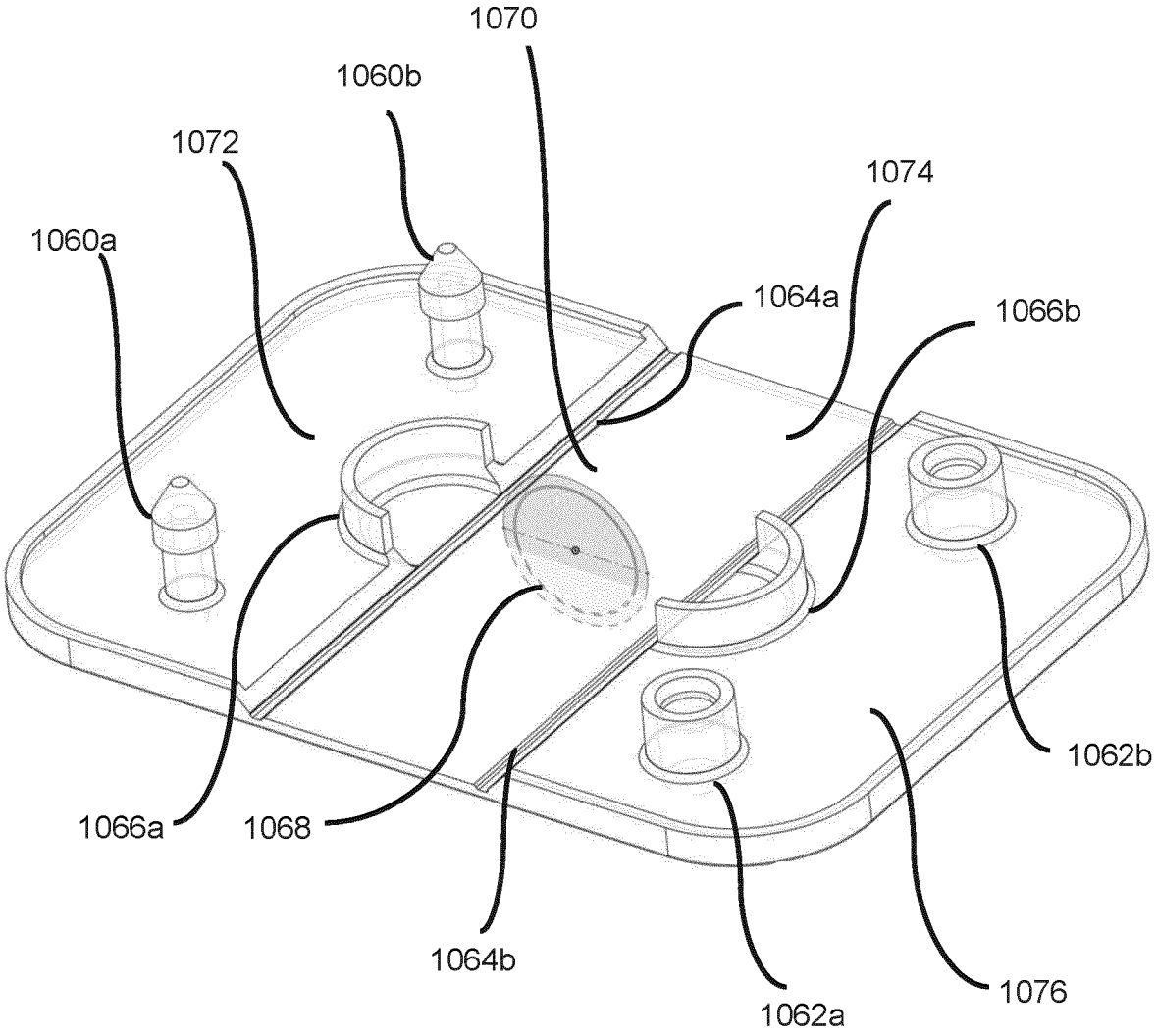
FIG. 10 shows an example part of the system.

FIG. 10 shows a safety clip 1070 that in some examples may be used to house a spherical magnet 1068. The safety clip 1070 may be used with any of the aforementioned panels.

Safety clip 1070 comprises two fold lines 1064*a* and 1064*b*. When fold lines 1064*a* and 1064*b* are folded, peg 1060*a* is received in receptacle 1062*a* and peg 1060*b* is received in receptacle 1062*b*. Spherical magnet 1068 can then be stored inside the safety clip which provides a capsule around spherical magnet 1068.

In some examples, pegs 1060*a* and 1060*b* engage with any of the aforementioned panels in order to be received in the respective receptacles 1062*a* and 1062*b*. Each peg may create an aperture in a panel when safety clip 1070 is folded adjacent to an edge of a panel. In some examples, pegs 1060*a* and 1060*b* may "punch through" the material of the panel in order to be received by receptacles 1062*a* and 1062*b*. In some examples, holes may be created for the pegs 1060*a* and 1060*b* to be passed through prior to the folding of the safety clip 1070.

Further, safety clip 1070 comprises a housing that can be used to house spherical magnet 1068. The housing is formed when ridges 1066*a* and 1066*b* come into contact after the clip is folded along lines 1064*a* and 1064*b*. When spherical magnet 1068 is housed in housing formed by 1066*a* and 1066*b*, it is still able to move and orientate in the presence of magnetic fields. As such, the safety clip mechanism can be placed over recesses provided in panels of the system such that the spherical magnets are stored in capsules without affecting the operation of the magnetic connection mechanism of the system.

By housing the magnets in safety clip mechanism 1070, if a user such as a child removes a safety clip such as safety clip 1070 out of a panel, the clip 1070 remains closed and the child will not be able to get the magnet out of safety clip mechanism 1070. This prevents the child being able to directly access magnet 1068 and prevents the child from causing damage to magnet 1068 or injuring themselves by e.g. swallowing magnet 1068.

When the housing clip is applied to a magnet of the system, faces 1072 and 1076 of the safety clip 1070 may come into contact with the top and bottom faces of the panel. Face 1074 of the safety clip may come into contact with an edge of the panel. Face 1074 may be curved when in contact with an edge of the panels of the system.

FIG. 11 shows an example of a safety clip 1170 engaged with a panel 1176 and spherical magnet 1178. The spherical magnet 1178 is housed in the safety clip 1170.

Safety clip 1170 may be similar to safety clip 1070 described above. Panel 1176 may be similar to any of the panels described above.

Spherical magnet 1178 is housed within safety clip 1170 with enough room to re-orientate when influenced by an external force such as a magnetic force. The spherical magnet 1170 is also housed in a recess in the edge of panel 1176.

In some examples, more than one safety slip may be provided for connection to a panel.

At points 1180*a* and 1180*b* pegs of the safety clip 1170 punch through the material of panel 1176 and are received by receptacles within the panel.

Even if a user manages to remove safety clip 1170 from panel 1176, safety clip 1170 will be closed such that the user is prevented from accessing spherical magnet 1178. This prevents the user being able to harm themselves using spherical magnet 1178 (e.g. by swallowing spherical magnet 1178).

The edges of safety clip 1178 may be curved to conform to a curved edge of panel 1176. It will be appreciated that in some examples the edges of safety clip 1178 may have an alternative shape to conform the to the shape of a different panel.

Figure 12A:
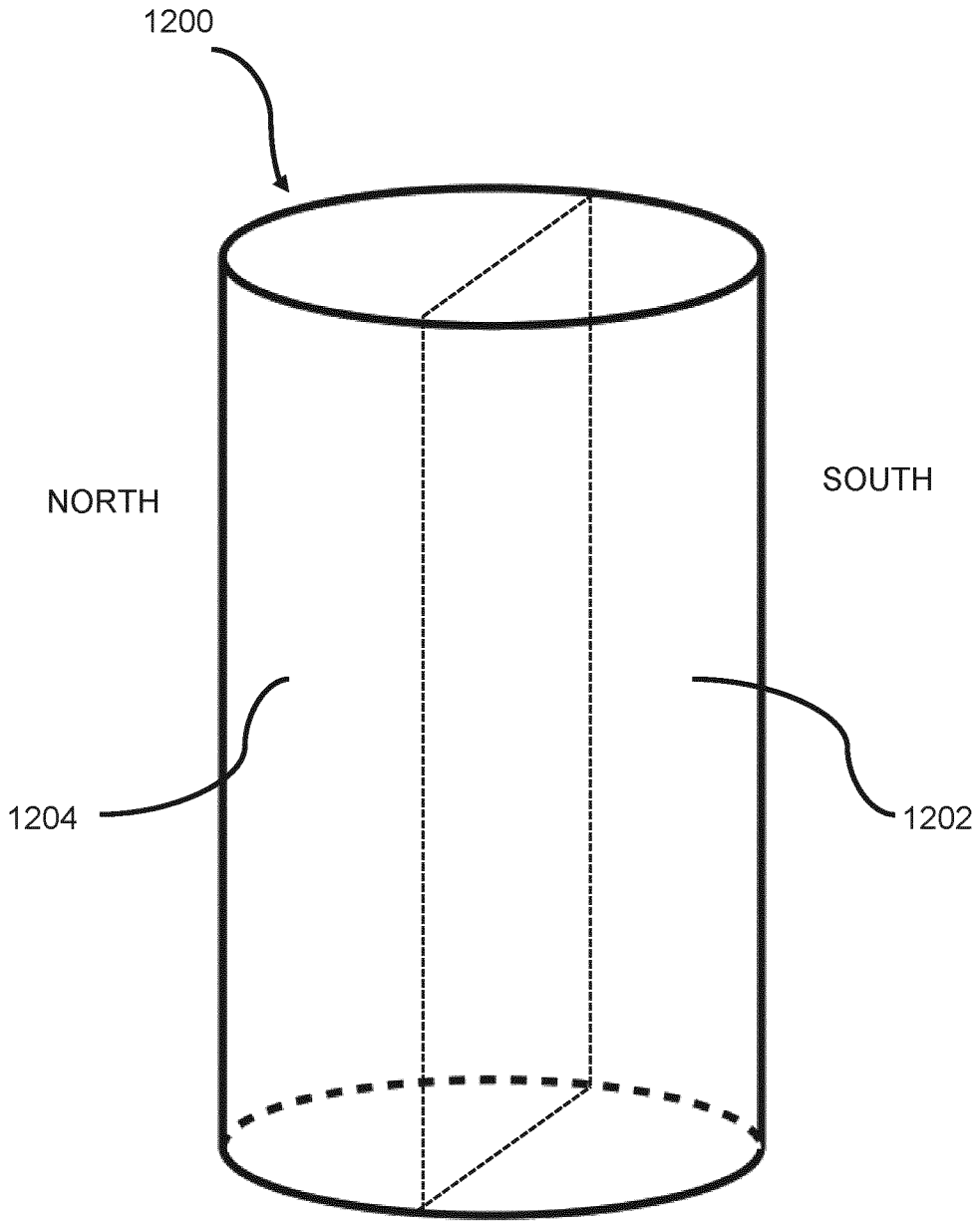
FIG. 12A shows an example magnet that can be used in the system.

In some examples, the panels may comprise a diametric magnet. In some examples, the diametric magnet may comprise a cylindrical magnet 1200 as shown in FIG. 12A.

Cylindrical magnet 1200 may be diametrically magnetized such that half of the curved face of magnet 1200 is magnetized north and the other half of the curved face of magnet 1200 is magnetized south. The magnetic pole of magnet 1200 may change from a north pole 1204 to a south pole 1202 along the diameter of magnet 1200.

When two diametrically cylindrical magnets such as magnet 1200 are urged towards each other, they will re-orientate to align the north pole of one magnet with the south pole of the other magnet. Each cylindrical magnet may re-orientate by rotating around an axis running through both of the flat faces of the magnet. For example, magnet 1200 may re-orientate by rotating around an axis passing through both of the flat faces of magnet 1200.

Figure 12B:
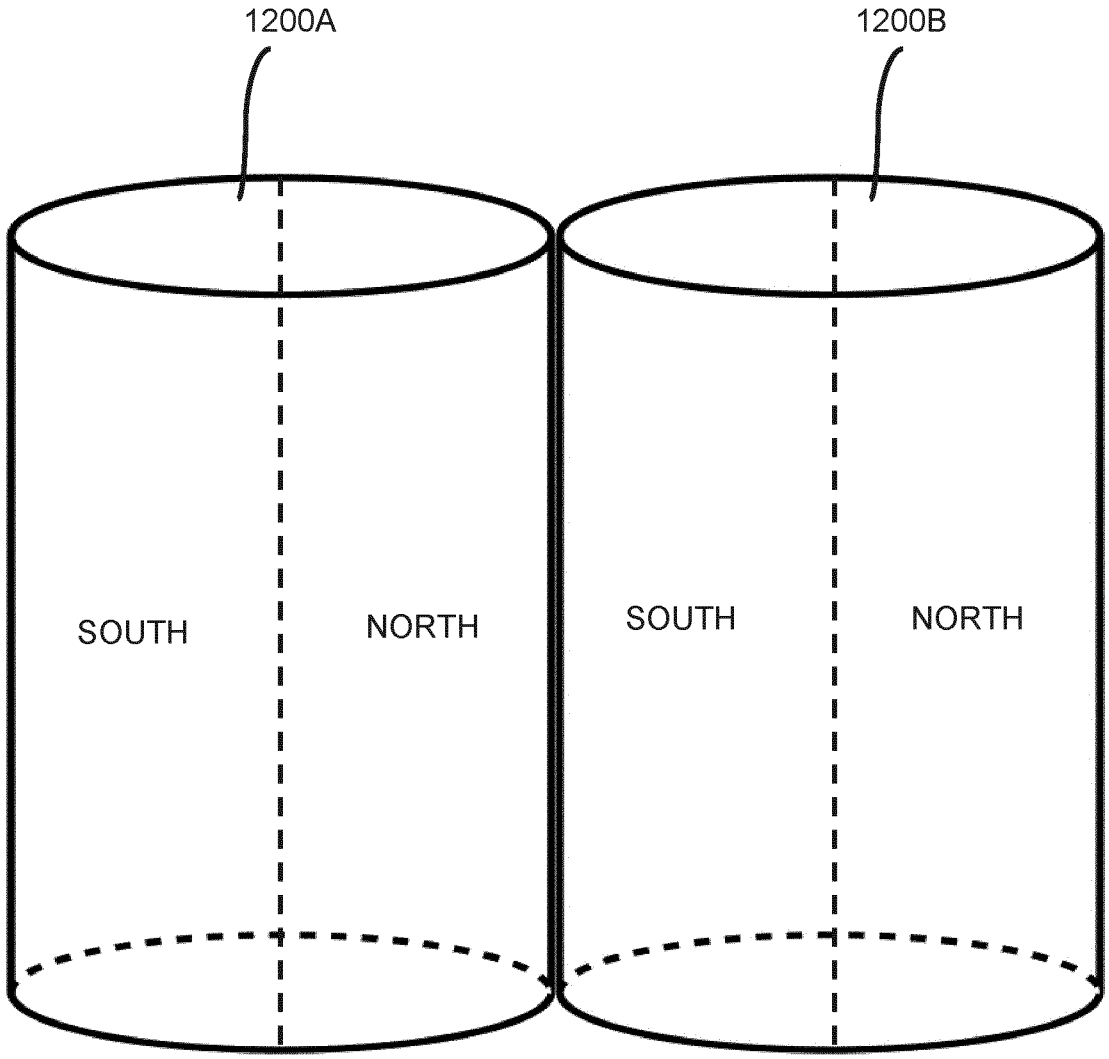
FIG. 12B shows an example of two magnets that can be used in the system.

FIG. 12B shows an example of how two cylindrical diametric magnets 1200A and 1200B may be attracted towards each other when the south pole of one magnet aligns with the north pole of the other.

Figure 13:
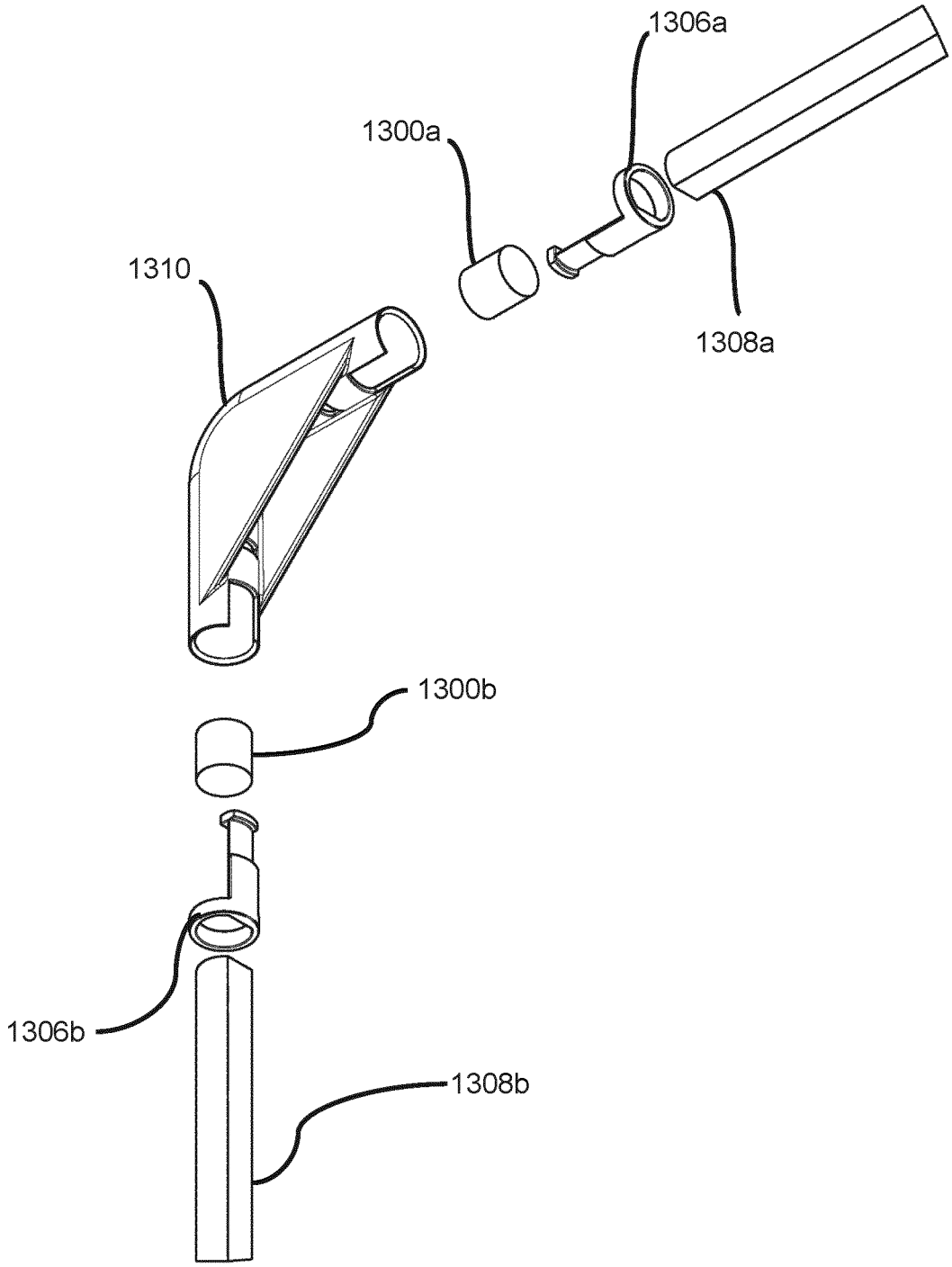
FIG. 13 shows an example part of the system.

FIG. 13 shows an example of a cylindrical magnet such as magnet 1200 can be incorporated into a connector 1310. FIG. 13 shows an exploded view of FIG. 14.

Figure 16:
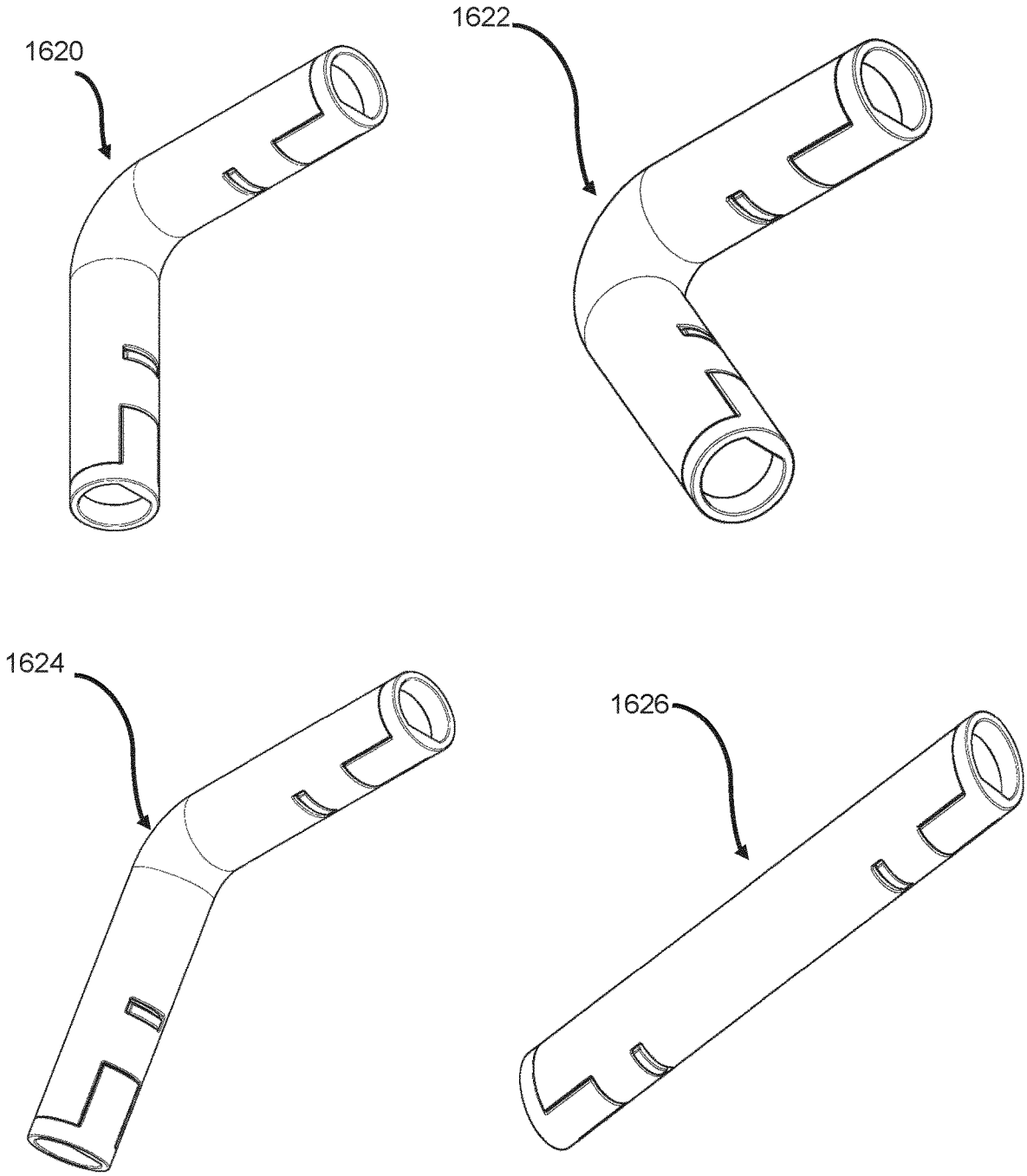
FIG. 16 shows example parts of the system.
Figure 17:
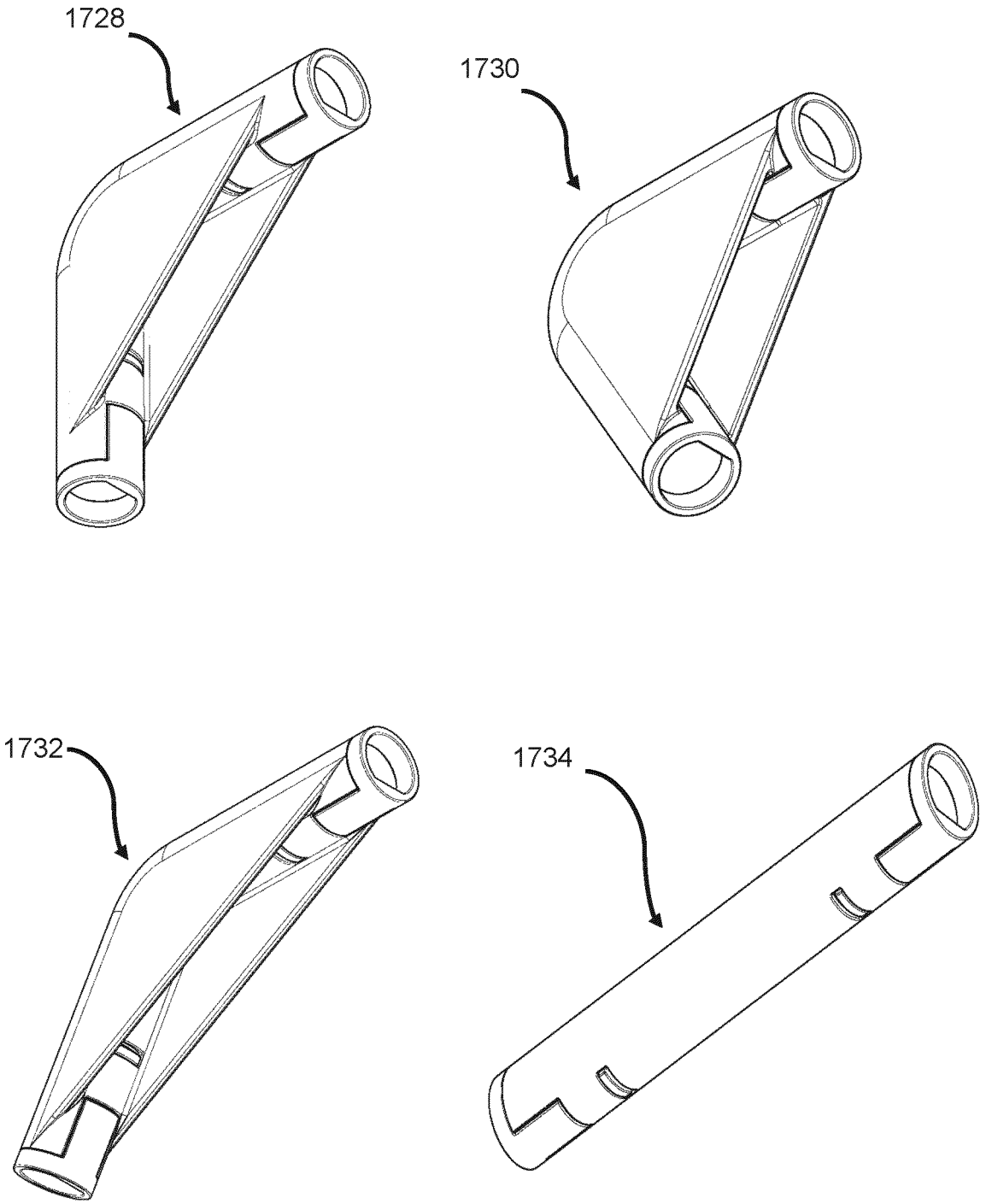
FIG. 17 shows example parts of the system.

Connector 1310 may comprise two housing portions, each housing portion for housing one of cylindrical magnets 1300*a* and 1300*b*. The housing portion may be positioned at different ends of connector 1310. In some examples, each housing portion may comprise a recess in which a magnet such as cylindrical magnets 1300*a* or 1300*b* could be housed. In some examples, each housing portion may comprise a compartment in which a magnet such as cylindrical magnets 1300*a* or 1300*b* could be housed. The connector 1310 may be used to connect two dowels 1308 and 1308*b* together. Connector 1310 shown in FIG. 13 can connect two dowels such that the dowels are positioned at a right angle to each other. It will be appreciated that similar connectors may be provided that can connect two dowels together at other angles, such as angles more acute than 90 degrees, more obtuse than 90 degrees or 180 degrees. Such connectors are shown in FIGS. 16 and 17. In some examples, a dowel may comprise a projecting peg, fastener, rod and/or peg.

Magnet 1300*a*, which may be a cylindrical diametric magnet similar to magnet 1200, may be held in a first housing portion of connector 1310. Magnet 1300*a* may be held in place by clip 1306*a*. Clip 1306*a* may clip magnet 1300*a* into a first housing portion of connector 1310. Clip 1306*a* may securely hold magnet 1300*a* in the first housing portion of connector 1310. In some examples, a clip may not be provided and dowel 1308*a* may hold magnet 1300*a* in connector 1310 and dowel 1308*b* may hold magnet 1300*b* in connector 1310.

On the face opposite the clipping mechanism of clip 1306*a*, a hole may be provided for housing a dowel 1308*a*. The dowel 1308*a* may be held in place in the hole in a number of ways. For example, dowel 1308*a* may be as push-fit, glued or welded, for example.

In some examples, the first housing portion of connector 1310 may be only slightly larger than magnet 1300*a*. In some examples, at least part of the first housing portion may be cylindrical. The cylindrical part of the first housing portion may have a diameter larger than magnet 1300*a*. This allows magnet 1300*a* to re-orientate inside the first housing portion when under the influence of an external magnetic field. In some examples the external magnetic field may be provided by a magnet in another connector of a different panel.

Magnet 1300*b*, which may be a cylindrical diametric magnet similar to magnet 1200, may be held in a second housing portion of connector 1310. Magnet 1300*b* may be held in place by clip 1306*b*. Clip 1306*b* may clip magnet 1300*b* into a second housing portion of connector 1310. Clip 1306*b* may securely hold magnet 1300*b* in the second housing portion of connector 1310.

On the face opposite the clipping mechanism of clip 1306*b*, a hole may be provided for housing a dowel 1308*b*. The dowel 1308*b* may be held in place in the hole in a number of ways, such as push-fit, glued or welded, for example.

In some examples, the second housing portion of connector 1310 may be only slightly larger than magnet 1300*b*. In some examples, at least part of the second housing portion may be cylindrical. The cylindrical part of the second housing portion may have a diameter larger than magnet 1300*b*. This allows magnet 1300*b* to re-orientate inside the second housing portion when under the influence of an external magnetic field. In some examples the external magnetic field may be provided by a magnet in another connector of a different panel.

Figure 14:
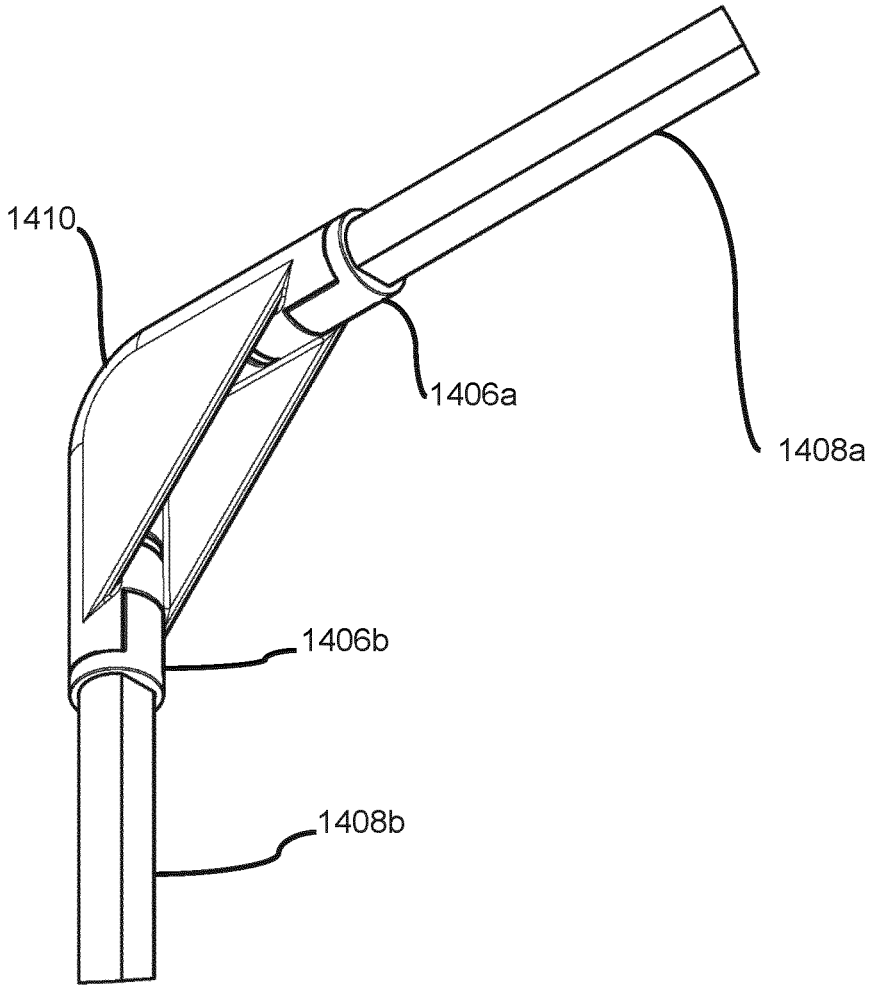
FIG. 14 shows an example part of the system.

FIG. 14 shows a connector 1410 connecting two dowels 1408*a* and 1408*b*. Dowels 1408*a* and 1408*b* are connected to clips 1406*a* and 1406*b* respectively. Cylindrical magnets are held inside connector 1410 similarly to the system shown in FIG. 13. As such, if an edge of connector 1410 is urged towards the edge of another similar connector, cylindrical magnets held in connector 1410 and the similar connector will re-orientate so that their magnetic fields align and the connectors are attracted towards each other. When these connectors are used to form panels, the cylindrical magnets can therefore be used to attract panels together to provide an automatic connection mechanism. This allows a user, such as a child, to easily connect any two or more panels by touching them together. It does not matter which way the child tries to connect the panels; the panels will stick to each other.

Figure 15:
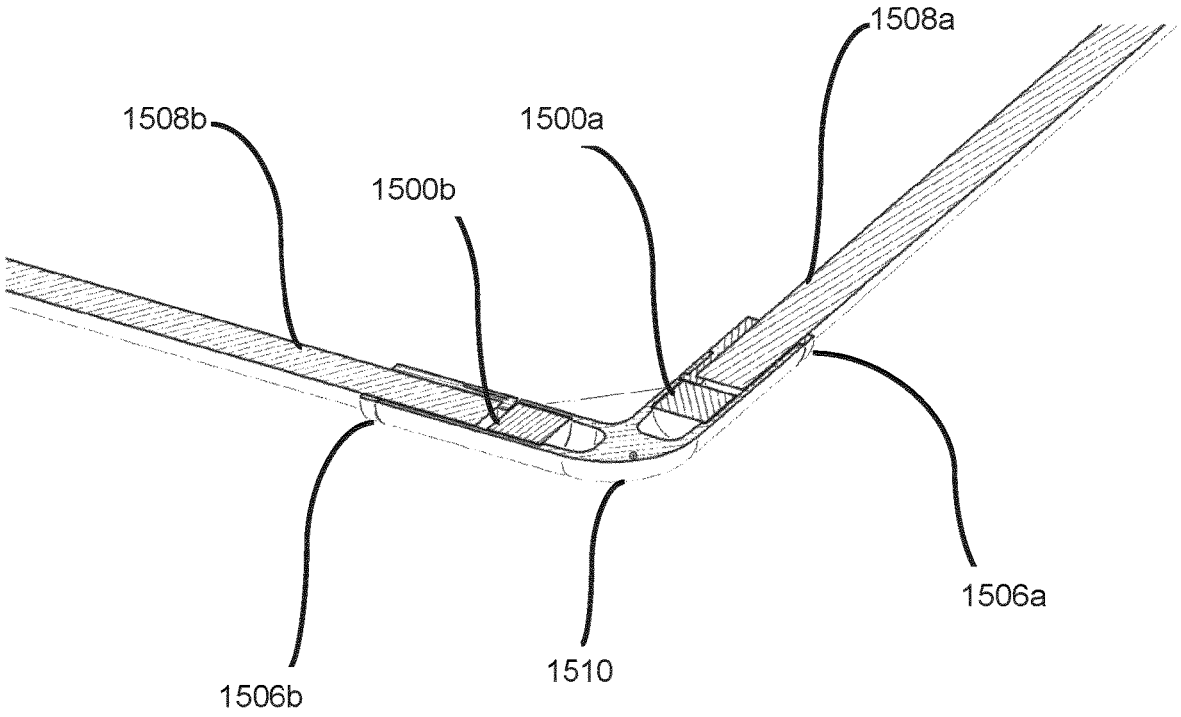
FIG. 15 shows a cross-section of an example part of the system.

FIG. 15 shows a cross section taken through a connector 1510. Connector 1510 may be similar to connector 1310 or 1410.

Dowel 1508*a* is held in a hole (e.g. a cavity or a recess) in clip 1506*a*. Dowel 1508*b* is held in a hole in clip 1506*b*. A first housing portion inside connector 1510 holds cylindrical diametric magnet 1500*a*. A second housing portion inside connector 1510 holds cylindrical diametric magnet 1500*b*.

Magnet 1500*a* is held in the first housing portion by clip 1506*a*. Magnet 1500*b* is held in the second housing portion by clip 1506*b*. The first housing portion provides enough space for magnet 1500*a* to re-orientate under the presence of an external magnetic field. The second housing portion provides enough space for magnet 1500*b* to re-orientate under the presence of an external magnetic field. If connector 1510 is urged towards a second connector which also houses cylindrical diametric magnets in a similar way, as a cylindrical diametric magnet is urged towards magnet 1506*a* or magnet 1506*b*, the magnets will re-orientate such that they are attracted towards each other. This can be used to connect panels together.

FIG. 16 shows 4 different shapes of connectors which can be used to hold cylindrical diametric magnets. Each connector can hold two cylindrical magnets in housing portions (e.g. internal recesses) using two clips in a similar manner to the systems shown in FIGS. 13,14 and 15. These connectors can also be used to connect dowels together to form panels.

Connector 1620 comprises a right-angle connector. This can be used to make corners of panels that are at right angles. For example, four right angle connectors could be used with dowels to make a square or rectangular panel.

Connector 1622 comprises an acute angle connector. This can be used to make corners of panels that are at angles less than 90 degrees. For example, three acute angle connectors could be used with dowels to make a triangular panel.

Connector 1624 comprises an obtuse angle connector. This can be used to make corners of panels that are at angles more than 90 degrees. For example, six obtuse angle connectors could be used to make a hexagonal panel. In other examples, two obtuse angle connectors, one straight connector and two acute angle connectors could be used with dowels to create a trapezium or half-hexagon panel.

Connector 1626 comprises a straight connector. This can be used to make connect dowels in panels that are at angles of 180 degrees. For example, a straight connector could be used to extend the length of one edge of a panel.

FIG. 17 shows further connectors 1728, 1730, 1732 and 1734. Connectors 1728, 1730, 1732 have an additional triangular piece in between each housing portion of the connectors. These triangular pieces can be used in some examples to provide additional support for dealing with tension in certain panel shapes.

FIG. 18 shows a square panel 1840 made using four right-angle connectors (similar to connectors 1310, 1410, 1510, 1620, 1728). One of the right-angle connectors is shown at 1810. It will be appreciated that shapes other than a square panel could be created using the different connectors shown in FIGS. 16 and 17. For example, the connectors could be combined with dowels to create a triangular panel; a square panel; a rectangular panel and/or a trapezoid panel.

Each of the connectors of panel 1840 (for example connector 1810) comprises two housing portions. Each housing portion houses a diametric cylindrical magnet that has enough room to re-orientate inside the housing portion. Each housing portion may be shaped to house an outer profile of the diametric cylindrical magnet.

Each connector has a clip (similar to clips 1306*a*, 1306*b*, 1406*a*, 1406*b*, 1506*a*, 1506*b*) that clips a magnet into each housing portion. The clip also comprises a hole on the opposite side of the housing portion for housing a dowel such as dowel 1808. Dowel 1808 is housed in a clip that is clipped into connector 1810 and a clip that is clipped into connector 1842. Dowel 1808 also passes through a sleeve 1808. Sleeve 1808 is connected to the central panel material 1836.

Each of the four dowels of 1840 passes through a sleeve which is connected to central panel material 1836.

In some examples the panel material 1836 may be made of any suitable material such as foam, polyester and/or polyethylene terephthalate (PET). In some examples, the dowels 1808 may be made of any suitable material, such as wood or metal. In some examples, the dowels 1808 may be made of bamboo.

Figure 19:
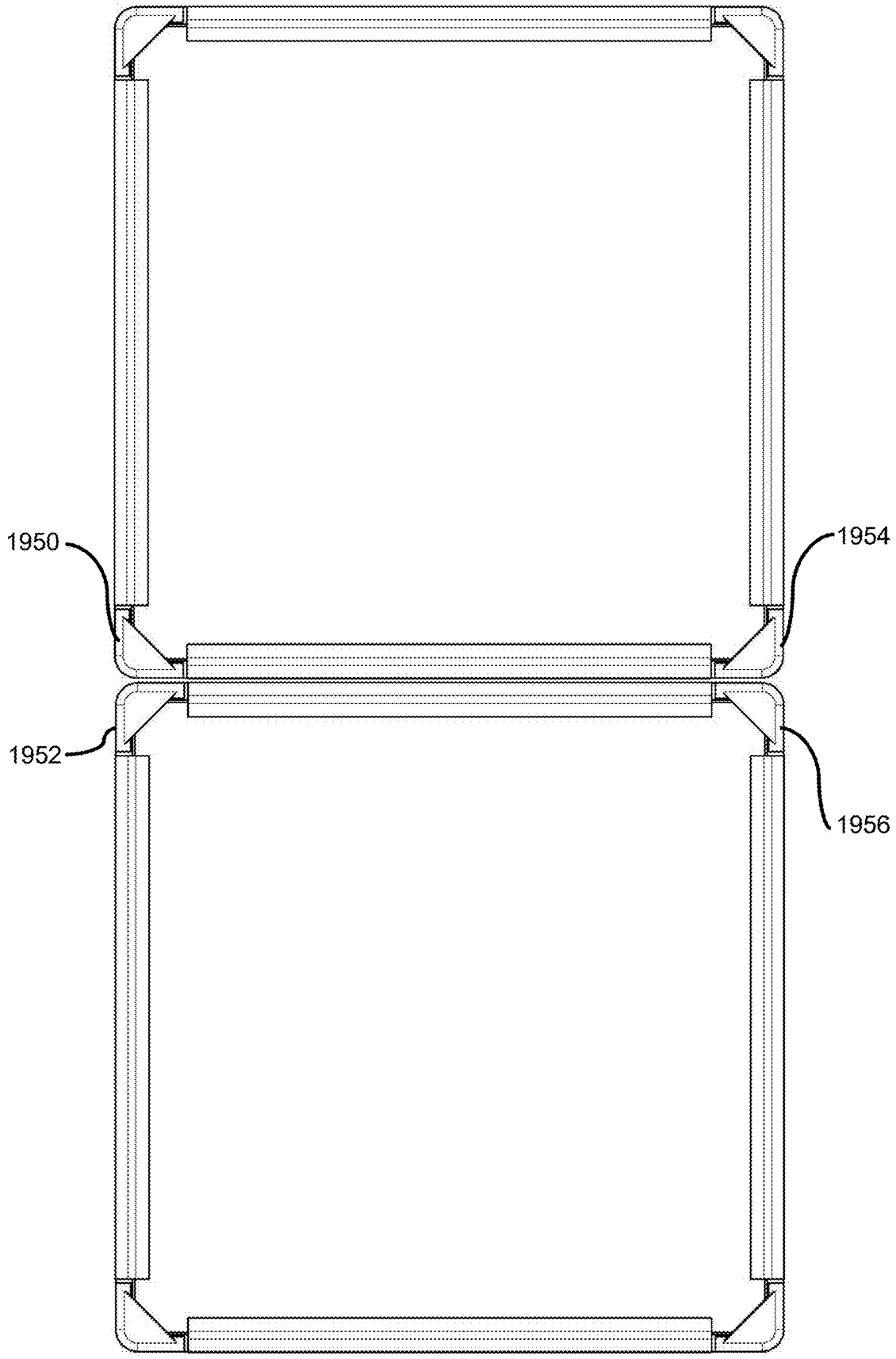
FIG. 19 shows an example part of the system.

FIG. 19 shows an example where two square panels comprising connectors housing cylindrical diametric magnets have been connected to each other. Each of connectors 1950, 1952, 1956 and 1954 houses two cylindrical diametric magnets, which may be clipped in as described above. The magnet in each connector closest to the other panel is re-orientated to align the magnet's diametric magnetic axis with the closest magnet in the other panel. As such, one magnet in connector 1950 is attracted towards one magnet in connector 1952. One magnet in 1954 is attracted towards magnet 1956. Users can use this magnetic attraction to describe structures as described above.

It will be understood that one or more panels having different shapes could be connected similarly to the method shown in FIG. 19 to form structures.

Magnetic blankets as described above with reference to FIGS. 6, 7 and 8 can also be combined with the diametric cylindrical magnet system to form structures.

Panels comprising spherical magnets can be attached to panels comprising cylindrical diametric magnets.

It will of course be understood that the examples described are by way of example only and are not intended to limit the scope of the invention. It will be also understood that any of the aforementioned examples may be combined.

The Figures are schematic in nature and not necessarily drawn to scale. It will be further understood that aspects of the described examples can be combined in any way.

The invention claimed is:

1. A system for building a play area comprising:

two or more panels, each of the two or more panels comprising:

a plurality of connectors, each connector of the plurality of connectors defining a first recess at a first end of the connector and a second recess at a second end of the connector;

a plurality of magnets, each magnet of the plurality of magnets positioned in a connector of the plurality of connectors such that the magnet is able to rotate, the plurality of magnets comprising:

a first magnet housed in the first recess of a first connector of the plurality of connectors; and a second magnet housed in the second recess of the first connector; and a plurality of dowels comprising:

a first dowel, a first end of which is received within the first recess of the first connector and a second end of which is received within the first recess of a second connector of the plurality of connectors; and a second dowel, a first end of which is received within the second recess of the first connector and a second end of which is received within the first recess of a third connector of the plurality of connectors, wherein the first connector is coupled to the first dowel and the second dowel, the second dowel angled with respect to the first dowel;

wherein, for each of the two or more panels,-when an edge of a first panel of the two or more panels is brought towards an edge of a second panel of the two or more panels from any direction, at least one magnet of the plurality of magnets in each of the first panel and the second panel orientates such that a magnetic connection is formed between the first panel and the second panel.

2. The system as claimed in claim 1, wherein the first dowel holds the first magnet in the first recess of the first connector and the second dowel holds the second magnet in the second recess of the first connector.

3. The system as claimed in claim 1, wherein at least one panel of the two or more panels further comprises fabric having sleeves through which the first dowel and second dowel pass through.

4. The system as claimed in claim 1, wherein the play area comprises a life-size play area comprising a structure between 0.5 meters and 2.5 meters tall.

5. The system according to claim 1, further comprising:

a first clip configured to hold the first magnet in the first recess of the first connector, wherein the first clip defines a hole to hold the first dowel; and a second clip configured to hold the second magnet in the second recess of the first connector, wherein the second clip defines a hole to hold the second dowel.

6. The system according to claim 1, wherein each of the two or more panels are formed by connecting the plurality of connectors and the plurality of dowels; and wherein each dowel of the plurality of dowels connects two of the plurality of connectors together.

7. The system according to claim 1, wherein each of the first magnet and the second magnet is a diametrically magnetized cylindrical magnet.

8. The system according to claim 1, wherein each recess of the first connector is shaped to house an outer profile of the at least one magnet.

9. The system according to claim 1, wherein the system further comprises at least one board configured to be connected to at least one panel of the two or more panels, wherein the at least one board is able to display at least one image.

10. The system according to claim 9, wherein a face of the at least one panel comprises at least one further magnet; and wherein the at least one board is able to be connected to the at least one further magnet to position the at least one board on the at least one panel.

11. The system according to claim 10, wherein the at least one board comprises a magnet and/or a metallic section to connect to the at least one further magnet of the face of the at least one panel.

12. The system according to claim 1, wherein the two or more panels comprise at least one of: a triangular panel; a square panel; a rectangular panel; or a trapezoid panel, and wherein at least one of the two or more panels defines an aperture which provides a window for the play area.

13. The system according to claim 1, wherein the system is able to be arranged to build the play area, and wherein the play area comprises at least one of: a play house; a stage; a scene; an exhibition display; a play car; a play spaceship; a box;

furniture; floor tiles; a floor mat of combined panels; a toy roadway, or a stage.

14. The system according to claim 1, comprising a foldable panel with pre-created fold lines about which the foldable panel is able to be folded to provide different shapes of the foldable panel, and wherein the foldable panel is able to be magnetically attached to the at least one magnet.

15. The system according to claim 1, wherein the system comprises a panel that comprises at least one spherical magnet, at least one of the first magnet and the second magnet comprising the at least one spherical magnet.

16. The system according to claim 1 wherein a frame of each of the two or more panels is formed by connecting the plurality of connectors and the plurality of dowels; and wherein each dowel of the plurality of dowels connects two of the plurality of connectors together.

17. A panel for building a play area, the panel comprising:

a connector defining a first recess at a first end of the connector and a second recess at a second end of the connector;

a plurality of magnets, each magnet positioned in the connector such that each magnet is able to rotate; and a plurality of dowels comprising:

a first dowel, a first end of which is received within the first recess; and a second dowel, a first end of which is received within the second recess;

wherein the plurality of magnets comprises a cylindrical magnet, the cylindrical magnet being diametrically magnetized;

wherein the plurality of magnets comprises:

a first magnet housed in the first recess; and a second magnet housed in the second recess; wherein the connector is coupled to the first dowel and the second dowel.

18. The panel according to claim 17, comprising a plurality of connectors comprising the connector and a plurality of dowels comprising the first dowel and the second dowel, wherein the panel is formed by connecting the plurality of connectors and the plurality of dowels; and wherein each dowel of the plurality of dowels connects two of the plurality of connectors together.

19. The panel according to claim 17, the panel comprising a frame, the frame comprising: a plurality of connectors comprising the connector; a plurality of dowels comprising the first dowel and the second dowel; wherein each dowel of the plurality of dowels connects two of the plurality of connectors together to form the frame.

20. The panel according to claim 17, wherein:

the second dowel is angled at a right angle, an acute angle, or an obtuse angle with respect to the first dowel.

21. The panel according to claim 20, wherein:

the first dowel holds the first magnet in the first recess; and the second dowel holds the second magnet in the second recess.

22. A method of manufacturing a panel, the panel for building a play area, the method comprising:

providing a connector defining a first recess at a first end of the connector and a second recess at a second end of the connector;

a plurality of magnets, each magnet housed in the connector such that the magnet is able to rotate, wherein the plurality of magnets comprises:

a first magnet housed in the first recess, the first magnet able to rotate in the first recess; and a second magnet housed in the second recess, the second magnet able to rotate in the second recess; and wherein each of the first magnet and the second magnet comprises a cylindrical magnet, the cylindrical magnet being diametrically magnetized; and coupling to the connector a plurality of dowels comprising a first dowel and a second dowel angled with respect to the first dowel, further comprising receiving the first dowel within the first recess and receiving the second dowel within the second recess.

23. The method according to claim 22, further comprising:

holding the first magnet in the first recess with the first dowel; and holding the second magnet in the second recess with the second dowel.

24. A system for building a play area comprising:

two or more panels, each of the two or more panels comprising:

a connector;

at least one magnet positioned in the connector such that the at least one magnet is able to rotate, the at least one magnet comprising:

a first magnet housed in a first end of the connector; and a second magnet housed in a second end of the connector;

wherein the at least one magnet comprises at least one cylindrical magnet, the at least one cylindrical magnet being diametrically magnetized;

a first dowel;

a second dowel, wherein the connector is coupled to the first dowel and the second dowel;

a first clip configured to hold the first magnet in the first end of the connector, wherein the first clip defines a hole to hold the first dowel; and a second clip configured to hold the second magnet in the second end of the connector, wherein the second clip defines a hole to hold the second dowel;

wherein, for each of the two or more panels, when at least one edge of a first panel of the two or more panels is brought towards at least one edge of a second panel of the two or more panels from any direction, the at least one magnet in each of the first panel and the second panel orientates such that a magnetic connection is formed between the first panel and the second panel.

* * * * *